US010109907B2

(12) United States Patent
Cooper et al.

(10) Patent No.: US 10,109,907 B2
(45) **Date of Patent: *Oct. 23, 2018**

(54) MULTI-MODE CAVITY FILTER

(71) Applicant: Mesaplexx Pty Ltd., Queensland (AU)

(72) Inventors: Steven John Cooper, Moorooka (AU); David Robert Hendry, Auchenflower (AU); Peter Blakeborough Kenington, Chepstow (GB)

(73) Assignee: Mesaplexx Pty Ltd., Queensland (AU)

( * ) Notice: Subject to any disclaimer, the term of this patent is extended or adjusted under 35 U.S.C. 154(b) by 84 days.

This patent is subject to a terminal disclaimer.

(21) Appl. No.: 14/769,278

(22) PCT Filed: Feb. 21, 2014

(86) PCT No.: PCT/GB2014/050524

§ 371 (c)(1),
(2) Date: Aug. 20, 2015

(87) PCT Pub. No.: WO2014/128489

PCT Pub. Date: Aug. 28, 2014

(65) Prior Publication Data

US 2016/0006104 A1 Jan. 7, 2016

(30) Foreign Application Priority Data

Feb. 21, 2013 (GB) ..... 1303018.4

(51) Int. Cl.
*H01P 7/10* (2006.01)
*H01P 1/208* (2006.01)
*H01P 1/207* (2006.01)

(52) U.S. Cl.
CPC ..... *H01P 7/105* (2013.01); *H01P 1/207* (2013.01); *H01P 1/2086* (2013.01)

(58) Field of Classification Search
CPC .. H01P 7/10; H01P 7/105; H01P 1/213; H01P 1/207; H01P 1/208; H01P 1/2086; H01P 1/2084; H01P 1/2082
(Continued)

(56) References Cited

U.S. PATENT DOCUMENTS 3,657,670 A 4/1972 Kitazume et al. ..... 333/73 W
4,675,630 A 6/1987 Tang et al.
(Continued)

FOREIGN PATENT DOCUMENTS

CN 102361113 A 2/2012
EP 0064799 A1 11/1982
(Continued)

OTHER PUBLICATIONS

Rosenberg, U., "Multiplexing and double band filtering with common-multimode cavities", Microwave Theory and techniques, IEEE Transactions, vol. 38, Issue 12, Dec. 1990, abstract only, 1 pg.
(Continued)

*Primary Examiner* — Stephen E. Jones
(74) *Attorney, Agent, or Firm* — Harrington & Smith

(57) ABSTRACT

A multi-mode cavity filter, including two dielectric resonator bodies, the first incorporating a piece of dielectric material having a shape to support a first resonant mode and a second substantially degenerate resonant mode; the second also including a piece of dielectric material; the piece of dielectric material having a shape to support a first resonant mode; a layer of conductive material in contact with and covering both of the dielectric resonator bodies; an aperture in the layer at the interface of the first and second dielectric resonator bodies, for transferring signals from the second dielectric resonator body to the first, transferring signals from the first dielectric resonator body to the second and/or outputting signals from the first dielectric resonator body,
(Continued)

the aperture being arranged for coupling signals to the first and second resonant modes in parallel, and/or coupling signals from the first and second resonant modes in parallel.

14 Claims, 23 Drawing Sheets

(58) Field of Classification Search
USPC ..... 333/202, 208, 209, 212, 219.1, 219, 230
See application file for complete search history.

(56) References Cited

U.S. PATENT DOCUMENTS

| | | | | |
|---|---|---|---|---|
| 4,879,533 | A | 11/1989 | de Muro et al. | 333/206 |
| 4,963,844 | A | 10/1990 | Konishi et al. | 333/208 |
| 5,023,866 | A | 6/1991 | de Muro | 370/24 |
| 5,307,036 | A | 4/1994 | Turunen et al. | 333/202 |
| 5,325,077 | A | 6/1994 | Ishikawa et al. | 333/219.1 |
| 6,016,091 | A | 1/2000 | Hidaka et al. | 333/202 |
| 6,025,291 | A | 2/2000 | Murakawa | 501/136 |
| 6,133,808 | A | 10/2000 | Arakawa | 333/134 |
| 6,160,463 | A | 12/2000 | Arakawa et al. | 333/202 |
| 6,346,867 | B2 | 2/2002 | Arakawa et al. | 333/208 |
| 6,549,094 | B2 | 4/2003 | Takagi et al. | 333/134 |
| 6,677,837 | B2 | 1/2004 | Kojima et al. | 333/208 |
| 6,762,658 | B1 | 7/2004 | Isomura et al. | 333/202 |
| 6,825,740 | B2 | 11/2004 | Kundu | 333/202 |
| 6,853,271 | B2 | 2/2005 | Wilber et al. | 333/209 |
| 6,954,122 | B2 | 10/2005 | Wilber et al. | 333/202 |
| 7,042,314 | B2 | 5/2006 | Wang et al. | 333/202 |
| 8,325,077 | B2 | 12/2012 | Gentric | 341/173 |
| 2001/0000429 | A1 | 4/2001 | Arakawa et al. | 333/208 |
| 2001/0024147 | A1 | 9/2001 | Arakawa et al. | 333/135 |
| 2002/0024410 | A1 | 2/2002 | Guglielmi et al. | 333/202 |
| 2002/0039058 | A1 | 4/2002 | Sano et al. | 333/202 |
| 2003/0006864 | A1 | 1/2003 | Hattori et al. | 333/202 |
| 2003/0090344 | A1 | 5/2003 | Wang et al. | 333/202 |
| 2003/0227360 | A1 | 12/2003 | Kirihara et al. | 333/239 |
| 2004/0056736 | A1 | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1 | 11/2005 | Enokihara et al. | 333/219.1 |
| 2006/0139127 | A1 | 6/2006 | Wada et al. | 333/202 |
| 2008/0018391 | A1 | 1/2008 | Bates | 327/557 |
| 2008/0211601 | A1 | 9/2008 | Bates | 333/186 |
| 2012/0049983 | A1* | 3/2012 | Uhm | H01P 1/2086 333/212 |
| 2013/0049890 | A1 | 2/2013 | Hendry et al. | 333/202 |
| 2013/0049891 | A1 | 2/2013 | Hendry et al. | 333/202 |
| 2013/0049892 | A1 | 2/2013 | Hendry et al. | 333/202 |
| 2013/0049901 | A1 | 2/2013 | Hendry et al. | 333/208 |
| 2013/0321720 | A1 | 12/2013 | Inada | 349/15 |
| 2014/0077900 | A1 | 3/2014 | Rogozine et al. | 333/212 |

FOREIGN PATENT DOCUMENTS

| | | | |
|---|---|---|---|
| EP | 1 544 939 | A1 | 6/2005 |
| EP | 2 432 070 | A1 | 3/2012 |
| FR | 2 675 952 | A1 | 10/1992 |
| JP | H-07283601 | A | 10/1995 |
| JP | 2002135003 | A | 5/2002 |

OTHER PUBLICATIONS

Dupont, "Properties Handbook", Dupont, p. 4 (30 pgs.), Nov. 2003.
"Triple-mode ceramic the key in ultra-compact filter research", Rahman, Mohammed M., et al., Proceedings of the 34$^{th}$ European Microwave Conference, Oct. 2004, 1 page.

* cited by examiner

MULTI-MODE CAVITY FILTER

TECHNICAL FIELD

The present invention relates to filters, and in particular to a multi-mode filter including a resonator body for use, for example, in frequency division duplexers for telecommunication applications.

BACKGROUND

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topography does not have to match the topography of the real filter.

Conventional single-mode filters formed from dielectric resonators are known. Dielectric resonators have high-Q (low loss) characteristics which enable highly selective filters having a reduced size compared to cavity filters. These single-mode filters tend to be built as a cascade of separated physical dielectric resonators, with various couplings between them and to the ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are coupled together by providing openings between cavities in which the resonators are located. Typically, the resonators and cross-couplings provide transmission poles and "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these undesirable for implementation at the top of antenna towers.

Multi-mode filters implement several resonators in a single physical body, such that reductions in filter size can be obtained. As an example, a silvered dielectric body can resonate in many different modes. Each of these modes can act as one of the resonators in a filter. In order to provide a practical multi-mode filter it is necessary to couple the energy between the modes within the body, in contrast with the coupling between discrete objects in single mode filters, which is easier to control in practice.

The usual manner in which these multi-mode filters are implemented is to selectively couple the energy from an input port to a first one of the modes. The energy stored in the first mode is then coupled to different modes within the resonator by introducing specific defects into the shape of the body. In this manner, a multi-mode filter can be implemented as an effective cascade of resonators, in a similar way to conventional single mode filter implementations. This technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

It is an advantage of at least one embodiment of the present invention that it enables the use of a probe to, indirectly, feed signals into a multi-mode resonator and a second probe to, indirectly, extract signals from the multi-mode resonator, without the need to introduce defects into the multi-mode resonator, whilst still enabling the multi-mode resonator to support multiple modes, simultaneously.

An alternative manner in which these multi-mode filters may be implemented is to couple the energy from an input port, simultaneously to each one of the modes, by means of a suitably designed coupling track. Again, in this manner, a multi-mode filter can be implemented as an effective cascade of resonators, in a similar way to conventional single mode filter implementations. As was the case above, in which defects were used to enable multiple modes to be excited in a single resonator, this technique results in transmission poles which can be tuned to provide a desired filter response. This type of filter has been disclosed in various US patent filings, for example: U.S. Ser. Nos. 13/488,123, 13/488,059, 13/487,906 and 13/488,172.

It is a further advantage of at least one embodiment of the present invention, to enable the signals to be filtered to be fed into, and extracted from, multiple modes, simultaneously, in parallel, within the multi-mode resonator, whilst not introducing additional resistive losses which would be the case when using conductive tracks as a mechanism for exciting multiple modes, simultaneously, within a multi-mode resonator or for extracting signals from multiple modes, simultaneously, within a multi-mode resonator.

Two or more triple-mode filters may still need to be cascaded together to provide a filter assembly with suitable filtering characteristics. As described in U.S. Pat. Nos. 6,853,271 and 7,042,314 this may be achieved using a single waveguide or a centrally-located single aperture for providing coupling between two resonator mono-bodies. With this approach, the precise control of the modes being coupled to, coupled from or coupled between the bodies, is difficult to achieve and thus, as a consequence, achieving a given, challenging, filter specification is difficult.

Another approach includes using a single-mode combine resonator coupled between two dielectric mono-bodies to form a hybrid filter assembly as described in U.S. Pat. No. 6,954,122. In this case, the physical complexity and hence manufacturing costs are even further increased, over and above the use of added defects alone.

SUMMARY OF INVENTION

According to an aspect of the present invention, there is provided a multi-mode cavity filter, comprising: at least two dielectric resonator bodies, the first dielectric resonator body incorporating a piece of dielectric material, the piece of dielectric material having a shape such that it can support at least a first resonant mode and at least a second substantially degenerate resonant mode; the second dielectric resonator body also comprising a piece of dielectric material, the dielectric properties, shape and dimensions of which may differ from those of the first dielectric resonator body; the said second piece of dielectric material having a shape such that it can support at least a first resonant mode; a layer of conductive material in contact with and covering both of the dielectric resonator bodies; at least one aperture in the layer or layers of conductive material appearing at the interface of the first dielectric resonator body and the second dielectric resonator body, for at least one of: transferring signals from the second dielectric resonator body to the first dielectric resonator body, transferring signals from the first dielectric resonator body to the second dielectric resonator body and outputting signals from the first dielectric resonator body, the at least one aperture being arranged for at least one of directly coupling signals to the first resonant mode and the second substantially degenerate resonant mode existing within the first dielectric resonator, in parallel, and directly coupling signals from the first resonant mode and the second substantially degenerate resonant mode existing within the first dielectric resonator, in parallel.

The at least one aperture may, for example, comprise at least one of an input coupling aperture and an output coupling aperture for respectively coupling signals to and from the dielectric resonator body.

The at least one aperture may, for example, consist of two or more parts, where a first part runs substantially parallel to a surface of the dielectric resonator body and a second part runs substantially perpendicular to the first part. The at least one aperture may, for example, be placed close to at least one edge of the dielectric resonator body.

The at least one coupling aperture may, for example, comprise a first portion primarily for coupling to a first mode and a second portion primarily for coupling to a second mode. The first portion of the at least one coupling aperture may, for example, be oriented such that at least one of the magnetic field and the electric field coupled by said first portion is substantially aligned with the respective magnetic field or electric field of said first mode. The second portion of the at least one coupling aperture may, for example, be oriented such that at least one of the magnetic field and the electric field coupled by said second portion is substantially aligned with the respective magnetic field or electric field of said second mode. The first portion and second portion may, for example, be any of the following: a straight, curved or amorphous aperture or a regular or irregular two-dimensional shape. The first portion may, for example, comprise a first straight elongate aperture and the second portion may, for example, comprise a second straight elongate aperture arranged substantially orthogonally to the first straight elongate aperture and which may intersect with the first straight elongate aperture or may be distinct from the first straight elongate aperture.

The at least one coupling aperture may, for example, comprise a portion for coupling simultaneously to both the first mode and the second mode. The portion may, for example, comprise an elongate aperture oriented at an angle such that at least one of the magnetic field and the electric field generated by said portion has a first Cartesian component aligned with the respective magnetic field or electric field of said first mode, and a second Cartesian component aligned with the respective magnetic field or electric field of said second mode.

The coupling aperture may, for example, be formed as an area devoid of conductive material, in the layer of conductive material.

The multi-mode cavity filter may, for example, further comprise an additional, or third, dielectric resonator; the third dielectric resonator body also comprising a piece of dielectric material, the dielectric properties, shape and dimensions of which may differ from those of the first and second dielectric resonator bodies, the said third piece of dielectric material having a shape such that it can support at least a first resonant mode; a layer of conductive material in contact with and substantially covering all surfaces of each of the dielectric resonator bodies; at least one aperture in the layer or layers of conductive material appearing at the interface of the third dielectric resonator body and the first dielectric resonator body, for at least one of outputting signals from the first dielectric resonator body to the third dielectric resonator body and transferring signals from the third dielectric resonator body to the first dielectric resonator body, the at least one aperture being arranged for at least one of directly coupling signals from the first resonant mode and the second substantially degenerate resonant mode existing in the first dielectric resonator body, in parallel, and directly coupling signals to the first resonant mode and the second substantially degenerate resonant mode existing in the first dielectric resonator body, in parallel.

The third resonator may be made of the same material as the first, multi-mode, resonator or it may be made from a different material. Likewise, the third resonator may be made of the same material as the second resonator or it may be made from a different material.

The piece of dielectric material forming the body of the multi-mode resonator, may, for example, comprise a first substantially planar surface for mounting to a planar surface on the second resonator. The piece of dielectric material forming the body of the multi-mode resonator, may also, for example, comprise a second substantially planar surface for mounting to a planar surface on the third resonator.

A first coupling aperture may, for example, be provided on or adjacent to said first substantially planar surface. A second coupling aperture may also, for example, be provided on or adjacent to said second substantially planar surface.

The second resonator may, in turn, be provided with a probe or other excitation means to enable signals to be fed into the second resonator. The third resonator may also be provided with a probe or other excitation means to enable signals to be extracted from the third resonator.

BRIEF DESCRIPTION OF THE DRAWINGS

For a better understanding of the present invention, and to show more clearly how it may be carried into effect, reference will now be made, by way of example, to the following drawings, in which:

FIG. 11(*b*) is a schematic diagram of an example of the frequency response of the multi-mode filter of FIG. 11(*a*);

FIG. 13(*b*) is a schematic diagram showing a side view of the example multi-mode filter of FIG. 13(*a*), incorporating input and output coupling probes;

FIG. 14(*b*) is a schematic perspective view of an example of a multi-mode filter showing various fields and modes within the resonators;

FIG. 14(*c*) is a schematic perspective view of an example multi-mode resonator showing example field orientations within the resonator.

DETAILED DESCRIPTION

Figure 1:
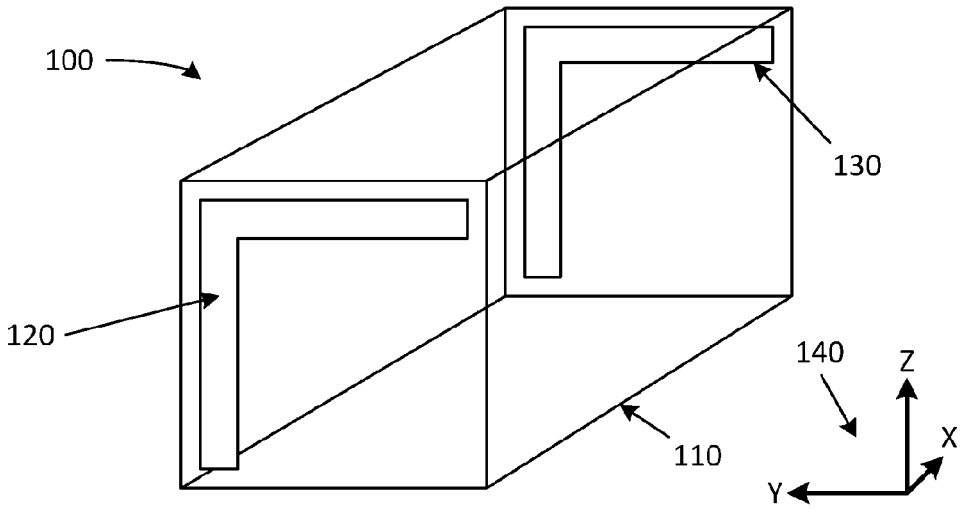
FIG. 1*a* is a schematic perspective view of an example of a multi-mode filter.
FIG. 1*b* is a schematic front-face view of the multi-mode filter of FIG. 1*a;*
Figure 1:
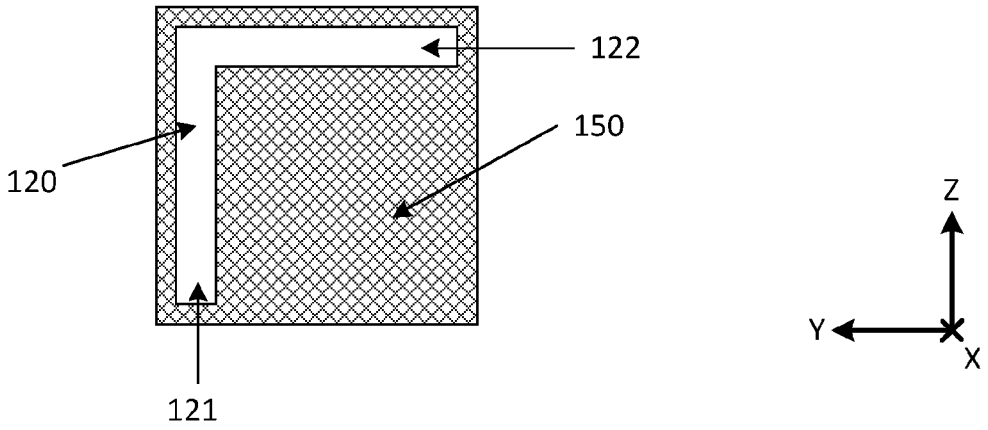

An example of a multi-mode filter will now be described with reference to FIGS. 1*a* and 1*b*.

The basis of this invention is in the use of a specific type of coupling aperture to couple signals into and out of a multi-mode resonator, whilst exciting (or coupling energy from) two or more modes, simultaneously, within that resonator.

In this example, the filter 100 includes a resonator body 110 which is encapsulated in a metallised layer (which is not shown, for clarity). At least two apertures are formed in the metallised layer: an input coupling aperture 120 and an output coupling aperture 130. These apertures are constituted by an absence of metallisation, with the remainder of the resonator body being substantially encapsulated in its metallised layer. The apertures 120 and 130 may be formed by, for example, etching, either chemically or mechanically, the metallisation surrounding the resonator body, 110, to remove metallisation and thereby form the one or more apertures. The one or more apertures could also be formed by other means, such as producing a mask in the shape of the aperture, temporarily attaching the said mask to the required location on the surface of the resonator body, spraying or otherwise depositing a conductive layer (the 'metallised layer') across substantially all of the surface area of the resonator body and then removing the mask from the resonator body, to leave an aperture in the metallisation.

The orientation of the axes which will be used, subsequently, to define the names and orientations of the various modes, within the multi-mode resonator 110, are defined by the axis diagram, 140.

FIG. 1*b* shows a view of the face of the resonator body 110 containing an input aperture 120. Input aperture 120 is shown as being formed by an absence of the metallisation 150 on the surface of an end face (as shown) of the resonator body 110, shown in FIG. 1(*a*).

The input aperture 120 is shown, in this example, as being composed of two orthogonal slots 121 and 122 in the metallisation 150. These two orthogonal slots 121 and 122 are shown to meet in the upper left-hand corner of the front face of the resonator body, to form a single, continuous aperture 120. The embodiment described above is only one of a large number of possible embodiments consistent with the invention. Further examples will be provided below, in which multiple separate slot apertures are used and where the said slot apertures do not meet or meet at a different location along their lengths, for example half-way along, thereby forming a cross.

Two coupling apertures are provided: one for coupling RF energy into the resonator and one for coupling RF energy from the resonator back out, for example to or from a further resonator, in each case. The further resonator could be a single-mode resonator, for example. These apertures respectively excite, or couple energy from, two or more of the simple (main) modes which the resonator structure can support. The number of modes which can be supported is, in turn, largely dictated by the shape of the resonator, although cubic and cuboidal resonators are primarily those considered in this disclosure, thereby supporting up to three (simple, non-degenerate) modes, in the case of a cube, and up to four (simple, non-degenerate) modes, in the case of a 2:2:1 ratio cuboid. Other resonator shapes and numbers of modes which such shapes can support are also possible.

FIG. 1(*a*) shows, by way of example, a cuboidal dielectric resonator body 110; many other shapes are possible for the resonator body, whilst still supporting multiple modes. Examples of such shapes for the resonator body include, but are not limited to: spheres, prisms, pyramids, cones, cylinders and polygon extrusions.

Typically the resonator body 110 includes, and more typically is manufactured from, a solid body of a dielectric material having suitable dielectric properties. In one example, the resonator body is a ceramic material, although this is not essential and alternative materials can be used. Additionally, the body can be a multi-layered body including, for example, layers of materials having different dielectric properties. In one example, the body can include a core of a dielectric material, and one or more outer layers of different dielectric materials.

The resonator body 110 usually includes an external coating of conductive material, typically referred to as a metallisation layer; this coating may be made from silver, although other materials could be used such as gold, copper, or the like. The conductive material may be applied to one or more surfaces of the body. A region of the surface, forming a coupling aperture, may be uncoated to allow coupling of signals to the resonator body.

The resonator body can be any shape, but generally defines at least two orthogonal axes, with the coupling apertures extending at least partially in the direction of each axis, to thereby provide coupling to multiple separate resonance modes.

In the current example, the resonator body 110 is a cuboid body, and therefore defines three orthogonal axes substantially aligned with surfaces of the resonator body, as shown by the axes X, Y, Z. As a result, the resonator body 110 has three dominant resonance modes that are substantially orthogonal and substantially aligned with the three orthogonal axes.

Cuboid structures are particularly advantageous as they can be easily and cheaply manufactured, and can also be easily fitted together, for example by arranging multiple resonator bodies in contact, as will be described below with reference to FIG. 6. Cuboid structures typically have clearly defined resonance modes, making configuration of the coupling aperture arrangement more straightforward. Additionally, the use of a cuboid structure provides a planar surface, or face, 180 so that the apertures can be arranged in a plane parallel to, or on, the planar surface 180, with the apertures optionally being formed from an absence of the metallisation which otherwise substantially surrounds the resonator body 110.

The adjoining materials and mechanisms from which the multi-mode dielectric resonator can source electric and magnetic field energy, which can then couple into the multi-mode resonator 110, and thereby excite two or more of the multiple modes which the resonator will support, are numerous. One example, which will be described further below, is to utilise one or more additional resonators, which may be single mode resonators, to contain the required electric and magnetic fields, to be coupled into the multi-mode resonator by means of the input coupling aperture 120. Likewise, the output coupling aperture 130 may couple the energy stored in the electric and magnetic fields within the multi-mode resonator 110, from two or more of its modes, into one or more output resonators, for subsequent extraction to form the output of the filter.

Whilst the use of input and output resonators as a means to provide or extract the required fields, adjacent to the coupling apertures 120 and 130, will be described further below, there are many other mechanisms by which the required fields may be provided or extracted. One further example is in the use of a radiating patch antenna structure placed at a suitable distance from the input coupling aperture 120. A suitably designed patch can provide the required electric and magnetic fields immediately adjacent to the input coupling aperture 120, such that the aperture 120 can couple the energy contained in these fields into multiple modes simultaneously, within the multi-mode resonator body 110.

Likewise, the use of a thin layer of metallisation, such as one deposited or painted onto the resonator body 110 is only one example of the form which the metallisation could take. A further example would be a metal box closely surrounding the resonator body 110. A yet further example could be the adhesion of thin metal sheeting or foil to the faces of the resonator body 110, with pre-cut apertures in the required locations, as described in the example of a metallisation layer, above.

In some scenarios, a single resonator body cannot provide adequate performance, for example, in the attenuation of out-of-band signals. In this instance, the filter's performance can be improved by providing two or more resonator bodies arranged in series, to thereby implement a higher-performance filter.

In one example, this can be achieved by providing two resonator bodies in contact with one other, with one or more apertures provided in the, for example, silver coatings of the resonator bodies, where the bodies are in contact. This allows the electric and magnetic fields present in the first cube to excite or induce the required fields and modes within the adjacent cube, so that a resonator body can receive a signal from or provide a signal to another resonator body.

Figure 2:
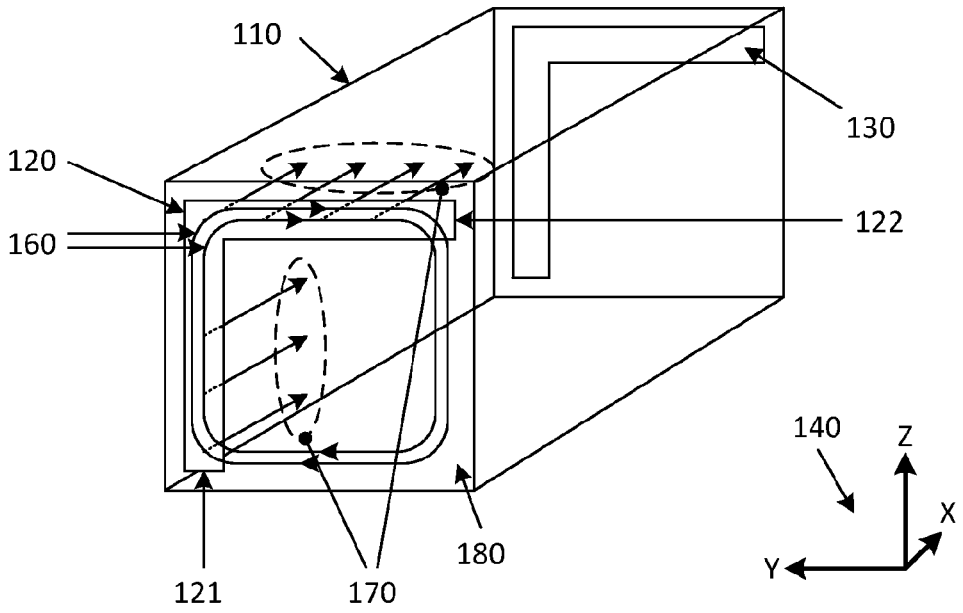
FIG. 2 is a schematic perspective view of the example multi-mode filter of FIG. 1*a* showing an example of one representative form for the electric and magnetic fields immediately outside of the front face of the multi-mode filter.
Figure 6:
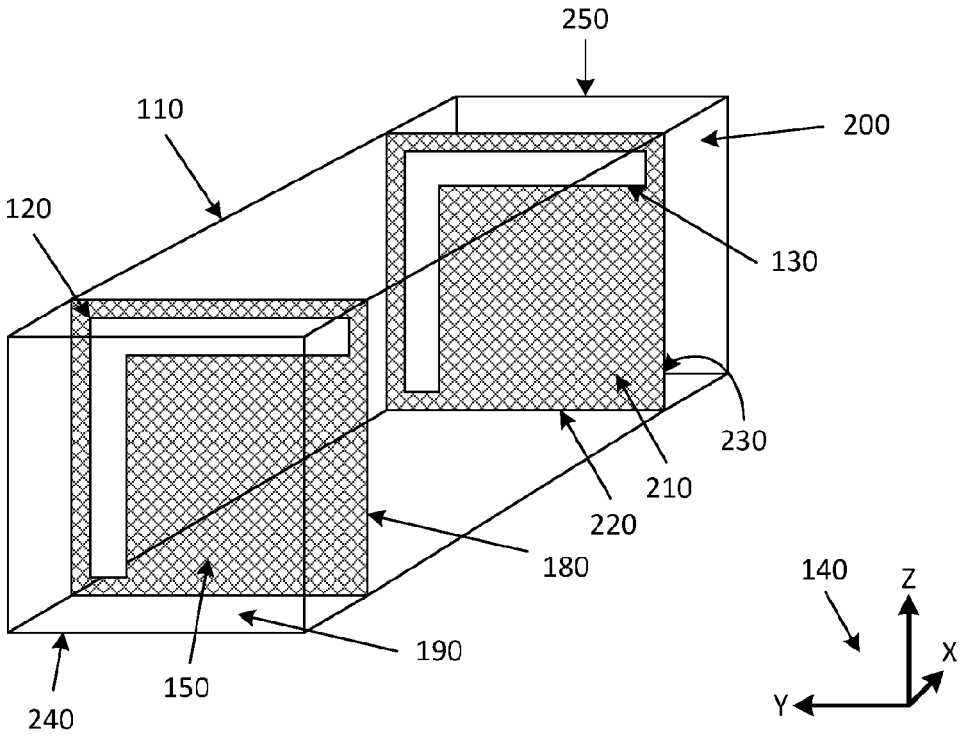
FIG. 6 is a schematic perspective view of the example multi-mode filter of FIG. 1 incorporating input and output coupling resonators.

FIG. 2 shows the form of the electric field (E-field) 170 and magnetic field (H-field) 160 which are typically present immediately outside of the resonator body, when a cuboidal single-mode input resonator, of the form shown as 190 in FIG. 6, is used to contain the fields to be coupled into the multi-mode resonator body 110; the E field is shown as the group of arrows 170 identified by the dashed loops. Alternative sources for the required E and H fields are possible, such as the patch antenna structure described above, and these may generate differently-shaped E and H fields to those shown in FIG. 2, however the principles of coupling energy into the multi-mode resonator, from these differently-shaped fields, are the same as will be described below, when considering a single-mode input resonator of the form shown as 190 in FIG. 6.

Operation of the input coupling aperture 120 can now be described with the aid of FIG. 2 is as follows. Electromagnetic energy, in the form of electric (E) and magnetic (H) fields existing immediately adjacent to the outside front face 180 of the resonator, can be coupled into the resonator, via the aperture 120, in two ways. The electric field (E-field) portion of the electromagnetic energy radiates through the aperture 120, as shown by the E-field directional arrows 170. The E-field radiation will primarily couple to the X-mode within the resonator, based upon the axis definition 140 shown in FIG. 2.

The H-field close to the edges of the face is shown as being quasi-square, as indicated by the two sets of H-field arrows 160, although it typically becomes increasingly circular and weaker closer to the centre of the face, as shown. The H-field will typically be at a maximum close to the edges of the resonator face 180 and at a minimum or zero in both the centre of the resonator face 180 and in the corners of the resonator face 180. This is why the H-field is shown as having rounded, rather than square or right-angle corners. The H-field 160 will typically couple to the up to three modes which can be supported by the shape shown in FIG. 2: X, Y and Z, via the two orthogonal aperture portions 121 and 122. Aperture portion 121 will primarily couple to the X and Y modes, whereas aperture portion 122 will primarily couple to the X and Z modes. It can be seen, from FIG. 2, that the circulating H-field 160 has a strong horizontal component existing parallel to the uppermost edge of the resonator face 180. This strong horizontal H-field component runs parallel to the horizontal (upper) aperture portion 122; this component, as shown, is at its largest in the centre of the upper edge of the aperture 122, with the aperture position shown. This strong horizontal component will typically couple most effectively to the Z mode within the resonator, based upon the axis definition 140 shown in FIG. 2. In addition, it will also typically couple strongly to the X mode by two mechanisms: H-field coupling, and E-field coupling through the aperture, as shown by the E-field directional arrows 170. These two mechanisms are in opposition to one another and it is often desirable to minimise the E-field coupling component to the X-mode and rely, as far as possible, upon the H-field component of coupling to the X-mode, in order to achieve the desired degree of X-mode coupling. One mechanism for achieving this goal will be described below, with reference to FIG. 3, although other options are possible.

Again, referring to FIG. 2, it is clear that the circulating H-field also has a strong component parallel to the vertical (left-hand) aperture portion 121; this component would again be at its largest in the centre of the upper edge of the aperture portion 121, with the aperture position shown. This strong vertical component will couple most effectively to the Y mode within the resonator, based upon the axis definition 140 shown in FIG. 2. In addition, it will also couple strongly to the X mode by the two mechanisms described previously: H-field coupling, and E-field coupling through the whole of aperture 120, incorporating aperture portion 121, as shown by the E-field directional arrows 170. These two mechanisms are, again, in opposition to one another and it is often desirable to minimise the E-field coupling component to the X-mode and rely, as far as possible, upon the H-field component in order to achieve the desired degree of X-mode coupling.

It is possible to control the level of coupling obtained in each mode by controlling the length, width and position of the two portions of the aperture (i.e. the horizontal and vertical portions 122 and 121). Likewise, changing the angle of one or both of the aperture portions, relative to the edges of the cuboid, would also have an impact upon the coupling strength achieved; with the E and H fields and multi-mode resonator shape 110 shown, altering the angle of one of the aperture portions 121 or 122 relative to the edges of the face 180 of the resonator, whilst keeping the other aperture portion fixed, would typically reduce the amount of coupling to the Z or Y modes, respectively, with a minimum amount of coupling being achieved, to the relevant mode, when the angle of the relevant aperture section (121 or 122) reached 45 degrees to its closest edge. Beyond that point, it would typically increase the coupling to the other mode; in other words an aperture portion originally intended to couple strongly to the Y mode, for example, would then couple more strongly to the Z-mode. It would also increase the amount of E-field coupling to the X-mode, since a portion of the aperture sections 121 and 122 would now be closer to the centre of the face 180 of the resonator, where the E-field is at its strongest. As a general principle, shorter, narrower apertures, when correctly oriented with respect to the electric or magnetic fields, or both, will reduce the amount of either electric or magnetic field coupling achieved, or both, whereas longer, wider apertures will increase it, at a given aperture position relative to the centre and edges of the resonator face 180. Likewise, altering the angle of the coupling aperture or aperture portion relative to the direction of the H-field will alter the degree of coupling to the relevant mode (Y or Z), based upon the resolved vector component of the H-field in the direction of the aperture or aperture portion.

Consider, now, the general case of arbitrarily shaped E and H-fields, existing within an illuminator, for example the input single-mode resonator 190 of FIG. 6, which is located adjacent to an arbitrarily-shaped multi-mode resonator, where these arbitrarily shaped E and H-fields are to be coupled into the said multi-mode resonator via one or more arbitrarily-shaped coupling apertures. The term 'illuminator' is used here to refer to any object, element or the like which can contain or emit E-fields, H-fields or both types of field. The arbitrary shape of the multi-mode resonator will result in arbitrarily-shaped field orientations being required within the multi-mode resonator to excite the resonator modes, for example the X, Y and Z-modes, existing within the said multi-mode resonator. In this example, the field orientations of both the multi-mode resonator and the illuminator are equally important in determining the degree of coupling which is achieved. Likewise, the shape, size and orientation of the one or more coupling apertures are also important.

The relationship may be explained as follows. The illuminator contains one or more modes, each with its own field pattern. The set of coupling apertures also have a series of modes, again, each with their own field pattern. Finally, the arbitrarily-shaped multi-mode resonator also has its own modes and its own field patterns. The coupling from a given illuminator mode to a given aperture mode will be determined by the degree of overlap between the illuminator and aperture field patterns. Likewise, the coupling from a given coupling aperture mode to a given multi-mode resonator mode will be given by the overlap between the aperture and multi-mode resonator field patterns. The coupling from a given illuminator mode to a given multi-mode resonator mode will therefore be the phasor sum of the couplings through all of the aperture modes. The result of this is that it is the vector component of the H-field aligning with the aperture and then with the vector component of the resonator mode which, along with the aperture size, determines the strength of coupling. If all of the vectors align, then strong coupling will generally occur; likewise, if there is a misalignment, for example due to one or more of the apertures not aligning either horizontally or vertically with the illuminator or resonator fields, then the degree of coupling will reduce. Furthermore, if one or more of the apertures, whilst being in perfect vector alignment, is reduced in size in the direction of the said vector alignment, then the degree of coupling will also typically reduce. In the case of the E-field, it is mainly the cross-sectional area of the aperture and its location on the face 180 of the resonator 110 which is important in determining the coupling strength. In this manner, it is possible to carefully control the degree of coupling to the various modes within the multi-mode resonator and, consequently, the pass-band and stop-band characteristics of the resulting filter.

The E-field and H-field illuminations shown in FIG. 2, indicated by the E-field directional arrows 170 and the H-field arrows 160 are based upon those which would be achieved by the placement of a single-mode dielectric resonator 190 immediately adjacent to the first face 180 of the resonator, as shown in FIG. 6. Note that FIG. 6 also shows metallisation 150 applied on a first resonator face 180 and also metallisation 210 applied on a second resonator face 220, but omits all other metallisation surrounding the multi-mode resonator 110 and the input single-mode resonator 190 and the output single-mode resonator 200. FIG. 6 will be discussed in more detail below. Clearly, other methods of illumination of the resonator face 180 are possible. Examples include, but are not limited to: a second multi-mode resonator (whether or not multiple modes are excited within it) placed or attached immediately adjacent to the resonator face 180, antenna radiating structures, such as patch antenna structures, which may be placed immediately adjacent to the resonator face 180 or some distance from the resonator face 180 or at any location in-between and strip-line or microstrip transmission lines or resonators placed immediately adjacent to the resonator face 180. Whilst these would generate different field patterns than those indicated by the reference numerals 160 and 170 in FIG. 2, for the E and H-fields (the H-field may no longer be quasi-square, for example), they do not detract from the basic concept of the invention, namely that of allowing largely independent 'sampling' of the E-field and the horizontal and vertical components of the H-field to take place in a carefully designed manner, utilising orthogonal aspects of the aperture or apertures wherein the one or more apertures are designed to have elements aligned with fields of the appropriate modes of the multi-mode resonator 110 and those of the illuminator.

To summarise, the main, but not the only factors required to obtain good coupling from the H-field present immediately outside of the resonator face 180, into the resonator body 110, via the one or more aperture portions 121 and 122, are:

1. Close vector alignment between the coupling aperture portion, for example aperture portions 121 or 122 in FIG. 2, and the H field of the cube mode to be excited. For example, a horizontal slot will provide good excitation to the Z mode and little excitation to the Y mode, with the modes as defined 140 in FIG. 2.

2. An appreciable extension of the coupling aperture in the relevant direction (for example the horizontal direction, in the case of the Z mode).

3. The placement of the coupling aperture 120 in a region where the H-field's field strength is highest, based upon the fields present immediately adjacent to the resonator face 180, both inside and outside of the resonator body 110. When considering the fields outside of the resonator body 110, such fields could, for example, be contained within the single-mode input resonator 190, shown in FIG. 6.

Figure 3:
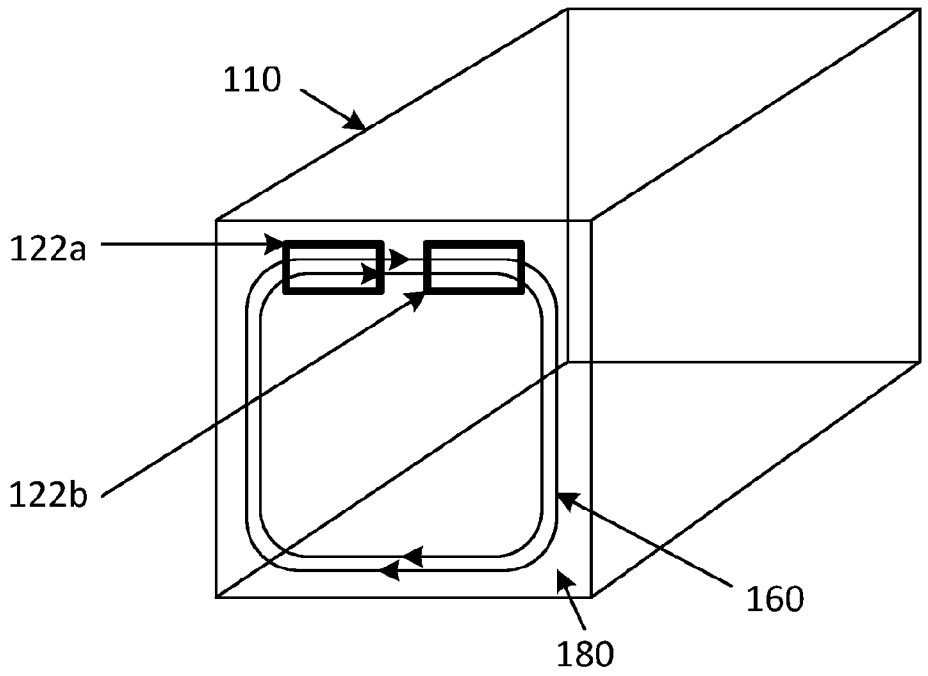
FIG. 3 is a schematic perspective view of a second example of a multi-mode filter.
Figure 4:
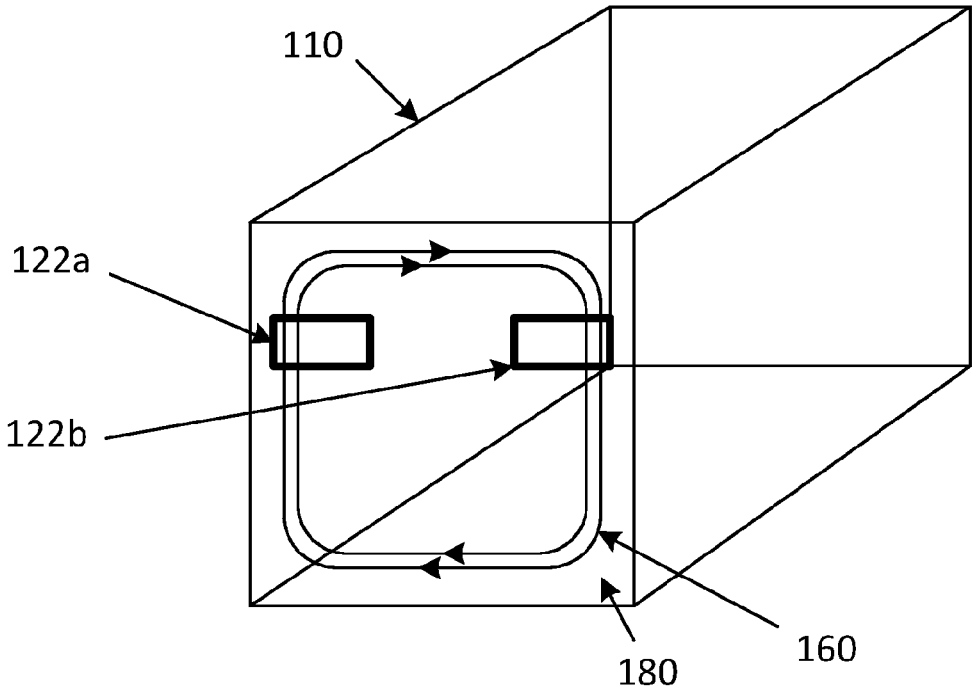
FIG. 4 is a schematic perspective view of a third example of a multi-mode filter.

With reference to FIG. 3 and FIG. 4, the above principles can now be illustrated further as follows, based upon the use of twin-aperture portions per orientation, with only the horizontal orientation being considered, for simplicity. FIG. 3 and FIG. 4 illustrate the use of aperture positioning in order to couple a greater or lesser amount of the H-field existing immediately adjacent to the face 180 of the resonator, but outside of the resonator body 110, to the appropriate mode existing within the multi-mode resonator body 110. FIG. 3 shows twin aperture sub-segments 122*a* and 122*b*, which may, together, perform a similar function to aperture portion 122 in FIG. 2. In FIG. 3, the aperture sub-segments 122*a* and 122*b* are placed close to the upper edge of the resonator face 180. In FIG. 4, the aperture sub-segments 122*a* and 122*b* are placed closer to the left and right-hand side edges of the resonator face 180, than they are to the upper edge of that face.

In the case illustrated in these two figures, it is the Z mode existing within the multi-mode resonator body 110 which is intended to be primarily coupled to, since the aperture sub-segments 122*a* and 122*b* are oriented horizontally. In addition significant coupling to the X-mode will also occur, however this would typically be the case irrespective of the orientation of the aperture portions 121 and 122 of FIG. 2 or the aperture sub-segments 122*a* and 122*b* of FIG. 3 and FIG. 4, so long as they remained in the same location or locations on the resonator face 180.

In FIG. 3, the aperture sub-segments 122*a* and 122*b* are shown as being relatively closely-spaced and also relatively close to the top of the resonator face 180. In this location, it can be seen that they will couple well to the strong horizontal component of the H-field, indicated by the H-field arrows 160, which is present close to the top of the resonator face 180. The H-field arrows 160 align, vectorially, in the same orientation as the aperture sub-segments 122*a* and 122*b* and thereby strong coupling to the Z mode present within the multi-mode resonator body 110 will typically occur.

In FIG. 4, the aperture sub-segments 122*a* and 122*b* are now located further apart and also lower down the face 180 of the multi-mode resonator body 110. The horizontal component of the H-field, as designated by the H-field arrows 160, is now smaller (the vertical component, in contrast, now being larger) and consequently a reduced amount of H-field coupling to the Z mode will occur. Conversely, however, if the aperture sub-segments 122*a* and 122*b* were kept in the same locations on the face 180 of the resonator body 110, as shown in FIG. 4, but each, individually, was rotated through 90 degrees, they would then typically provide a strong coupling magnitude to the Y-mode, from the H-field present immediately in front of the face 180 of the resonator body 110, although the couplings would typically be of opposing signs, due to the opposing field directions at the locations of aperture sub-segments 122*a* and 122*b*, and may therefore largely or entirely cancel each other out.

Note that whilst two separate aperture sub-segments are shown in both FIG. 3 and FIG. 4, the same arguments would hold true for a single aperture, for example aperture portion 122 in FIG. 2; aperture portion 122 may be thought of as a long 'slot' encompassing both of the short 'slots' 122*a* and 122*b* of FIG. 3. The main difference, from a coupling perspective, between the use of a single aperture portion, 122 and two aperture sub-segments, 122*a* and 122*b*, is that a greater degree of E-field coupling would typically be achieved using the single aperture portion 122 than would be achieved with the two aperture sub-segments 122*a* and 122*b*, assuming that the total length and the total aperture area occupied by the aperture sub-segments 122*a* and 122*b* is less than the total length and the total aperture area, respectively, of aperture portion 122. This increased degree of E-field coupling arises due to the increased useable area of the aperture portion and also from the stronger E field which is present closer to the centre of the face and which would typically be coupled by the central section of aperture portion 122. Such a large amount of E-field coupling is often undesirable, particularly when added to the E-field coupling which can arise from a similar pair of aperture sub-segments arranged vertically, to couple primarily to the Y-mode, such as apertures 312*a* and 312*b* in FIG. 10(*a*), which will be discussed on more detail below.

With regard to the degree of E-field coupling which may be achieved using one or more aperture portions or aperture sub-segments, there are a range of factors which influence this. These include, but are not limited to:

1. Placement of the coupling aperture in a region where the E-field strength is highest, based upon the E-field present immediately adjacent to the face 180 of the resonator, but outside of the resonator body 110. In this case, the E-field coupling will typically be strongest close to, or at, the centre of the face 180 of the resonator body 110.

2. The provision of a large cross-sectional area for the coupling aperture 120, with an extension in both horizontal and vertical directions which corresponds to the shape of the E-field intensity present immediately adjacent to the face 180 of the resonator body 110. For example, a circular or a square aperture, placed at the centre of the face 180 of the resonator body 110, when employing a single-mode input resonator 190, as shown in FIG. 6, would typically result in a large amount of E-field coupling taking place into the resonator body 110.

It is worth emphasising the point that an almost analogous situation exists, regarding aperture positioning and its impact upon coupling strength, for the E-field as has been discussed (above) for the H-field. In the case of the example architecture shown in FIG. 6, when considering the H-field, positioning the aperture(s) close to the edge of the face of the slab typically leads to a maximum level of coupling being achieved, assuming that the sub-apertures 121 and 122 are oriented appropriately to match the desired field direction at that location. In the case of the E-field, positioning the one or more apertures close to the centre of the face 180 of the multi-mode resonator body 110, leads to a maximum level of coupling. In this case, the orientation of the one or more apertures is largely unimportant. The shape of the aperture is now of greater relevance, with a circular shape typically providing a maximum amount of coupling relative to the area occupied by the coupling aperture, whilst removing the minimum amount of metallisation and hence having the minimum impact upon resistive losses in the filter.

Figure 5:
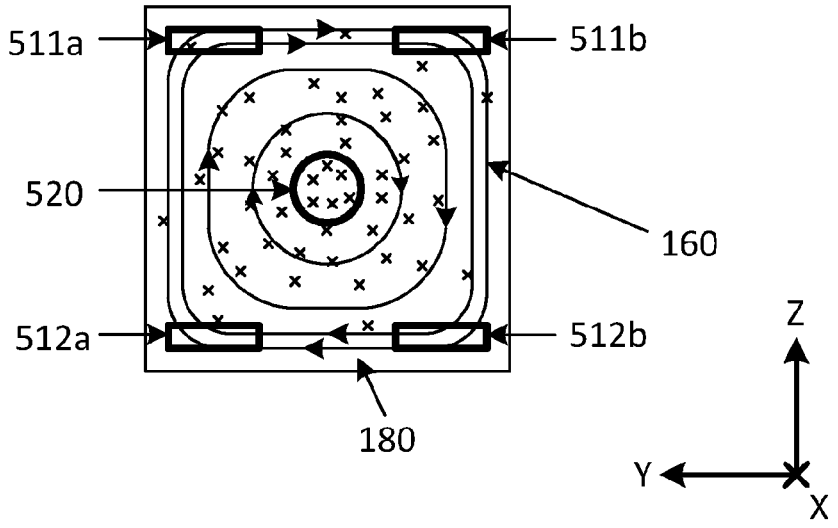
FIGS. 5(*a*) to (*d*) show various fields and modes outside of and within an example multi-mode resonator.
Figure 5:
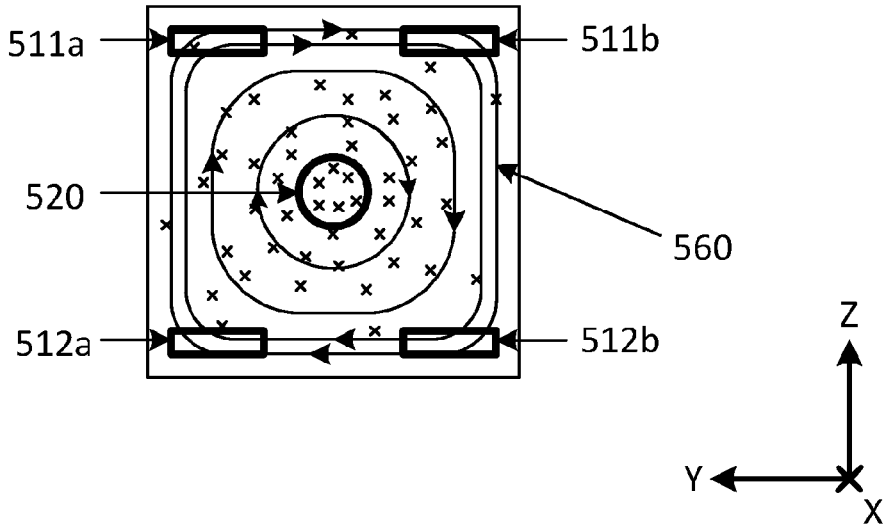
Figure 5:
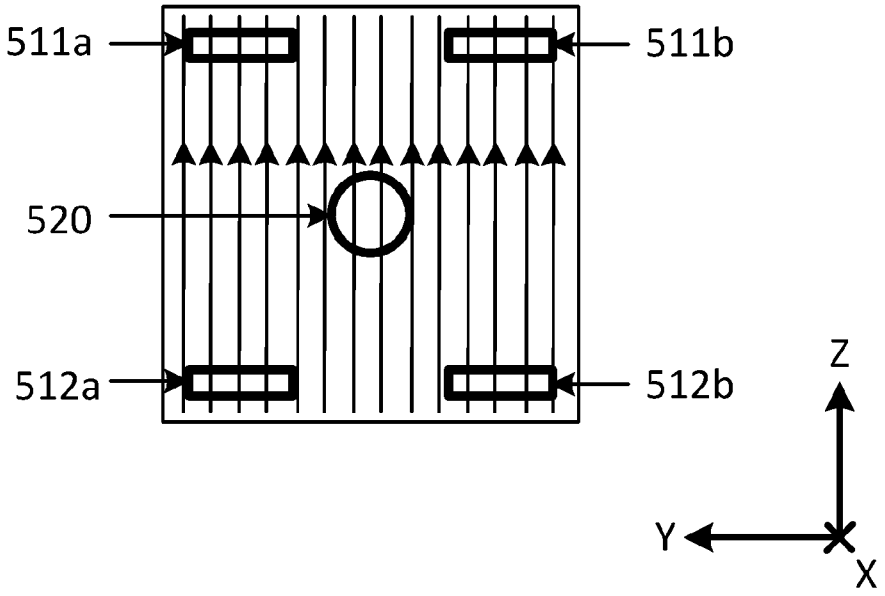
Figure 5:
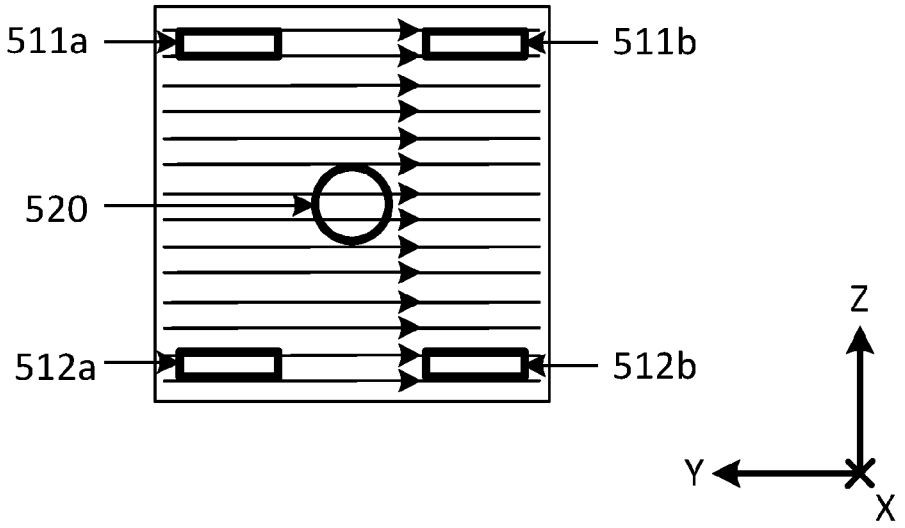

FIG. 5 illustrates a specific example in order to highlight the general principle of the invention. FIGS. 5(*a*) to (*d*) show an example coupling aperture arrangement consisting of four horizontally-oriented, narrow, apertures 511*a*, 511*b*, 512*a*, 512*b* and a single circular aperture 520 at the centre of the input face 180 of the multi-mode resonator. FIG. 5(*a*) illustrates the field distribution which is assumed to exist outside of, but immediately adjacent to, the input face 180 of the multi-mode resonator. This field distribution is of a form which can exist within a single-mode input resonator, as previously discussed. In FIG. 5(*a*), the H-field is shown by means of the solid lines, with arrowheads, 160, roughly circulating in a clockwise direction. Likewise, the E-field is shown by means of the small crosses—these are used to indicate that the E-field is directed roughly perpendicular to the page, approximately heading into the page. It should be noted that the density of the crosses is greater at the centre of the face 180 of the resonator, than it is toward the edges of the face. Likewise, the greater concentration of the H-field lines toward the outside edges of the face 180 and the lower concentration toward the centre of the face 180 show that the typical H-field distribution is such that a stronger H-field is usually present nearer to the edges and a lower H-field strength is usually present closer to the centre.

FIGS. 5(*b*) to (*d*) now show the field patterns existing immediately inside of the multi-mode resonator, in other words, immediately adjacent to the inside of the input face 180 of that resonator, for the three modes which can exist in a cube-shaped resonator, if such a resonator is excited appropriately. FIG. 5(*b*) shows a typical field pattern for the X-mode within the multi-mode resonator, based upon the excitation shown in FIG. 5(*a*). It can be seen that the X-mode field pattern is similar to that of the excitation field pattern shown in FIG. 5(*a*). The E-field of the X-mode is directed away from the input coupling apertures 511*a*, 511*b*, 512*a*, 512*b* in a direction roughly heading into the page. This is the x-direction, as indicated by the axes also shown in this figure.

FIG. 5(*c*) shows a typical field pattern for the Y-mode within the multi-mode resonator. It can be seen that the Y-mode field pattern differs substantially from that of the excitation field pattern shown in FIG. 5(*a*), for both the E and H-field components. The E-field of the Y-mode on this face is very small. The E-field of the Y-mode in the centre of the multi-mode resonator is large and propagates from left to right, in the Y-direction as indicated by the axes also shown in this figure. The H-field is shown as propagating from bottom to the top of the diagram, using the solid arrows.

Finally, FIG. 5(*d*) shows a typical field pattern for the Z-mode within the multi-mode resonator. It can be seen that the Z-mode field pattern also differs substantially from that of the excitation field pattern shown in FIG. 5(*a*), for both the E and H-field components. The E-field of the Z-mode, propagates from the bottom to the top of the diagram, in the Z-direction as indicated by the axes also shown in this figure, however as it is typically small, or zero, at the faces of the multi-mode resonator, it is not shown in this diagram; it would exist as described above, at the centre of the multi-mode resonator. The H-field is shown as propagating from left to right, using the solid arrows. It should be noted that the absolute directions of the E and H-fields are shown for illustrative purposes and field patterns oriented in the opposite directions to those shown are also possible.

Based upon the example field patterns shown in FIG. 5, it is possible to provide an approximate indication of the relative coupling strengths which could, typically, be achieved, with the coupling aperture arrangement shown in this figure. Such an indicative summary is provided in Table 1, below. Specifically, this shows the coupling which may be achieved when using only narrow, horizontally-oriented coupling apertures (or 'slots'), plus a central, circular, coupling aperture. In a typical, triple-mode filter, for example, it would be normal to also include vertically-oriented coupling apertures, to provide strong H-field coupling to the Y-mode; when using horizontal apertures, no vertical apertures, and assuming that any central aperture is perfectly centred and perfectly symmetrical, then minimal or no Y-mode coupling would typically occur.

Table 1 assumes that a single-mode cuboidal resonator, with a substantially square cross-section, is used to excite, by means of apertures located in its substantially square face, a cubic multi-mode resonator; both resonators having the aperture pattern shown in FIGS. 5(*a*) to (*d*) on their interfacing surfaces. With such an arrangement, and a suitable excitation device for the single-mode cuboidal input resonator, for example a probe, then field patterns similar to those shown in FIGS. 5(*a*) to (*e*) could be expected.

TABLE 1

| | | | Single-mode Resonator X-mode | |
|---|---|---|---|---|
| | Resonator Mode | Aperture (see FIG. 5) | E-field coupling | H-field coupling |
| Multi-mode Resonator | X-mode | Apertures 511a & 511b | Weak (+) | Strong (−) |
| | | Apertures 512a & 512b | Weak (+) | Strong (−) |
| | | Aperture 520 | Strong (+) | Weak (−) |
| | Y-mode | Apertures 511a & 511b | 0 | 0 |
| | | Apertures 512a & 512b | 0 | 0 |

TABLE 1-continued

| Resonator Mode | Aperture (see FIG. 5) | Single-mode Resonator X-mode E-field coupling | Single-mode Resonator X-mode H-field coupling |
|---|---|---|---|
| | Aperture 520 | 0 | 0 |
| Z-mode | Apertures 511a & 511b | 0 | Strong (−) |
| | Apertures 512a & 512b | 0 | Strong (+) |
| | Aperture 520 | 0 | 0 |

Table 1 may be interpreted as follows. The first resonator, in this case a single-mode input resonator, will typically only resonate in its X-mode, when fed with a probe, for example. This single (X) mode will couple to the multiple modes which can be supported by the multi-mode resonator, by means of both its E and H fields, as highlighted by the vertical columns of Table 1. The coupling apertures are numbered according to the scheme shown in FIG. 5(*a*), so apertures 511*a* and 511*b*, for example, are the upper two apertures in that figure. Taking these as an example, it can be seen, from Table 1, that the E-field present in the input single-mode resonator can weakly couple, with a 'positive' coupling, to the X-mode of the multi-mode resonator via apertures 511*a* and 511*b*. Likewise the H-field present in the input single-mode resonator can strongly couple, with a 'negative' coupling, to the X-mode of the multi-mode resonator via apertures 511*a* and 511*b*. The overall resultant coupling from the weak 'positive' coupling, resulting from the E-field present in the single-mode resonator, and the strong 'negative' coupling, resulting from the H-field present in the single-mode resonator, is a fairly strong negative coupling, based upon the two coupling apertures 511*a* and 511*b* only. Further contributions to the X-mode present in the multi-mode resonator will also result from apertures 512*a* and 512*b* and also the central aperture 520. Apertures 512*a* and 512*b* will, in effect, further strengthen the 'negative' signed coupling arising via from apertures 511*a* and 511*b*, however aperture 520 will counter-act this with the addition of strong 'positive' coupling. The resultant overall coupling to the X-mode will therefore depend upon how strong this positive coupling from aperture 520 is designed to be. If no central coupling aperture 520 is present, or this aperture is small, then the H-field coupling via apertures 511*a*, 511*b*, 512*a* and 512*b* will dominate; if, on the other hand, aperture 520 is large, then it could dominate the coupling to the X-mode. The final outcome is a matter of design choice, depending upon the particular filter specification to be achieved.

In the same manner, considering now the Z-mode within the multi-mode resonator, apertures 511*a* and 511*b* will generate strong negative coupling to this mode and apertures 512*a* and 512*b* will generate strong positive coupling to this mode. As drawn in FIG. 5(*a*), where roughly equally-sized apertures are shown, these contributions may therefore roughly cancel each other out and only a weak or zero coupling to the Z-mode is likely to occur. In a typical practical design, one or more apertures would typically be reduced in size relative to the remainder, or one or more apertures may be eliminated entirely, in order to ensure some resultant coupling takes place. So, for example, apertures 512*a* and 512*b* may be made smaller than apertures 511*a* and 511*b*, such that their coupling contribution is weakened, thereby allowing the coupling contribution from apertures 511*a* and 511*b* to dominate.

It is worth noting that the zero ("0") entries shown in Table 1 are illustrative of the fact that very minimal levels of coupling are likely to result, from the relevant combination of circumstances which gives rise to that particular entry; a zero ("0") entry does not necessarily imply that no excitation whatsoever will occur to that mode, by the relevant combination of circumstances which gives rise to that particular zero entry.

As has already been described, briefly, above, FIG. 6 illustrates the addition of an input single-mode resonator 190 and an output single mode resonator 200 to the multi-mode resonator 110. The input single mode resonator 190 is typically attached to the front face 180 of the multi-mode resonator 110. The output single mode resonator 200 is typically attached to the rear face 230 of the multi-mode resonator 110. The input single mode resonator 190 and the output single mode resonator 200 are typically formed from a dielectric material. The dielectric material used may be the same dielectric material as is used to fabricate the multi-mode resonator body 110 or it may be a different dielectric material. The dielectric material used to fabricate the input single mode resonator 190 may be a different dielectric material to that used to fabricate the output single mode resonator 200. Both the input single mode resonator 190 and the output single mode resonator 200 are typically substantially coated in a metallisation layer, except for the aperture areas 120 and 130, respectively, over which the metallisation is removed or within which metallisation was not placed during the metallisation process. FIG. 6 shows clearly, by means of cross-hatching, the area over which the metallisation 150 on the input face 180 of the multi-mode resonator body 110 extends and the area of the aperture 120, over which the metallisation is absent. Note that the remainder of the metallisation, which is typically applied to the remaining surfaces of the multi-mode resonator body 110, the surfaces of the input resonator 190 and the surfaces of the output resonator 200, is omitted from FIG. 6, for clarity. The only exception to this is that metallisation 210 is shown on the surface of the output face 230 of the of the multi-mode resonator body 110, again by means of cross-hatching. It also shows the area of the aperture 130, over which the metallisation is absent, by an absence of cross hatching.

One purpose of the addition of single-mode resonators 190, 200, to the input and output faces 180, 230, of the triple-mode resonator body 110, is to contain the electromagnetic fields, for example H-field 160 and E-field 170, shown in FIG. 2 for the input single mode resonator 190, which can then be coupled into the multi-mode resonator body 110, or which have been extracted from the multi-mode resonator body 110, in the case of the output single mode resonator 200.

The single-mode resonators 190, 200 may be supplied with a radio frequency signal or may have a radio frequency signal extracted from them, in a variety of ways, which are not shown in FIG. 6, however one example architecture and method will be described later, with reference to FIG. 13. The means by which radio frequency signals may be supplied or extracted include, but are not limited to: probes either touching the outer-most surface or penetrating the outer-most surface 240, 250 in FIG. 6 of the input single-mode resonator 190 or the output single-mode resonator 200, respectively, single or multiple patches or patch antennas located in a suitable position or positions to provide the required electromagnetic field or fields to, or extract the required electromagnetic field or fields from, the single-mode resonators 190, 200, and either single or multiple conductive loops, again located in a suitable position or positions to provide the required electromagnetic field or fields to, or extract the required electromagnetic field or fields from, the single-mode resonators 190, 200.

The input and output single-mode resonators 190, 200 are also substantially covered in a metallic coating, in the same manner as the multi-mode resonator body 110, and also have apertures, within which substantially no metallisation is present, which typically correspond, in both size and location, to the apertures in the coating on the multi-mode resonator body 110. The input and output single-mode resonators 190, 200 are in direct or indirect electrical contact with, and typically also mechanically attached to, the multi-mode resonator body 110 at the locations shown in FIG. 6—that is to say that the metallisation layers on the outside of the single-mode and multi-mode resonators are typically electrically connected together across substantially all of their common surface areas. Such a connection could be made by soldering, for example, although many other electrically-conductive bonding options exist.

The apertures 120, 130 in both the single and adjacent multi-mode resonators are, typically, substantially identical in shape, size and position on the relevant face of the resonator, such that they form, in essence, a single aperture, with a shape substantially identical to either of the apertures present on the relevant faces of the resonators, when the resonators are bonded together at those relevant faces. It is, however, possible to apply metallisation to only a single surface, either the output face of the input single-mode resonator or the input face of the multi-mode resonator, with the aperture or apertures incorporated into this single metallisation layer and then to bond this metallised surface to an adjacent resonator, which could have, as its bonding face, an un-metallised surface, with the remainder of that resonator being metallised. Care needs to be taken with this method of construction, however, to ensure that the bonding material, for example glue, is substantially of a uniform thickness. A separate electrical connection, between the metallisation on the two resonators is also, typically, required, for example at the top, the bottom and on both sides of both the input and output single-mode resonators 190, 200 and the multi-mode resonator body 110, to form, in effect, a continuous metallisation surrounding the whole filter structure, excluding the input and output connectors, probes or apertures.

Note that the term 'substantially identical', used above, is intended to include the case where one aperture is deliberately made slightly larger than an adjoining (facing) aperture, in order to simplify the alignment of the two apertures and thereby avoid mis-alignment problems between the two apertures.

Figure 7:
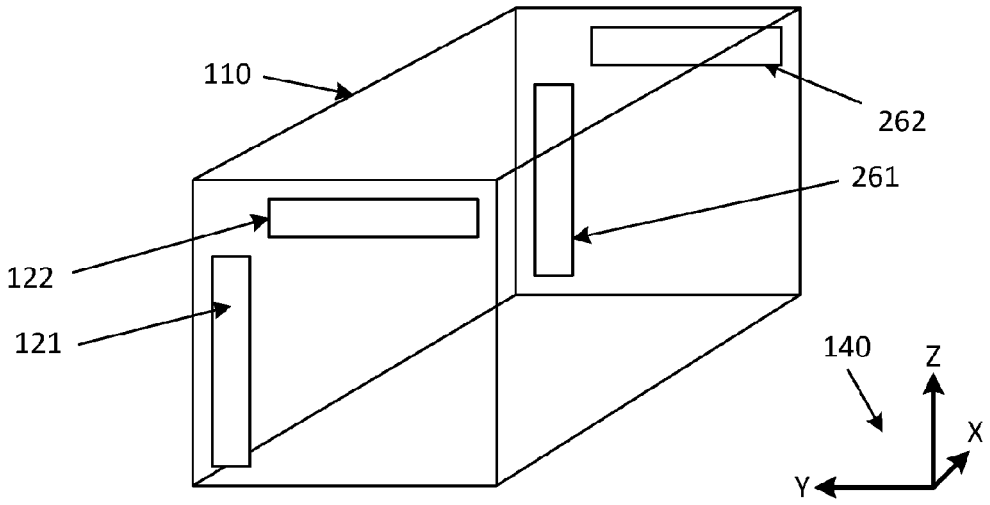
FIG. 7 is a schematic perspective view of a fourth example of a multi-mode filter.

It is not necessary for the apertures portions shown in FIG. 2 to meet at any point along their length, in order for them to function as coupling apertures according to one aspect of the present invention. FIG. 7 illustrates the use of separate input apertures portions 121, 122, which do not meet at any point along their length and also output portions, 261, 262, which, again, do not meet at any point along their length. The operation of these pairs of apertures is similar to that described above in relation to aperture portions 121, 122 in FIG. 2. The advantage of the arrangement shown in FIG. 2 is that it increases the length of both the horizontal and vertical aperture portions, 122 and 121 respectively, relative to those shown in FIG. 7 and thereby the strength of coupling which can be achieved, by each of them, to the desired modes in the multi-mode resonator body 110. It is, however, frequently undesirable to have too much coupling into the multi-mode resonator body 110 and hence shorter length aperture portions or even multiple sub-apertures, as in FIG. 3, for example, are often necessary.

Figure 8:
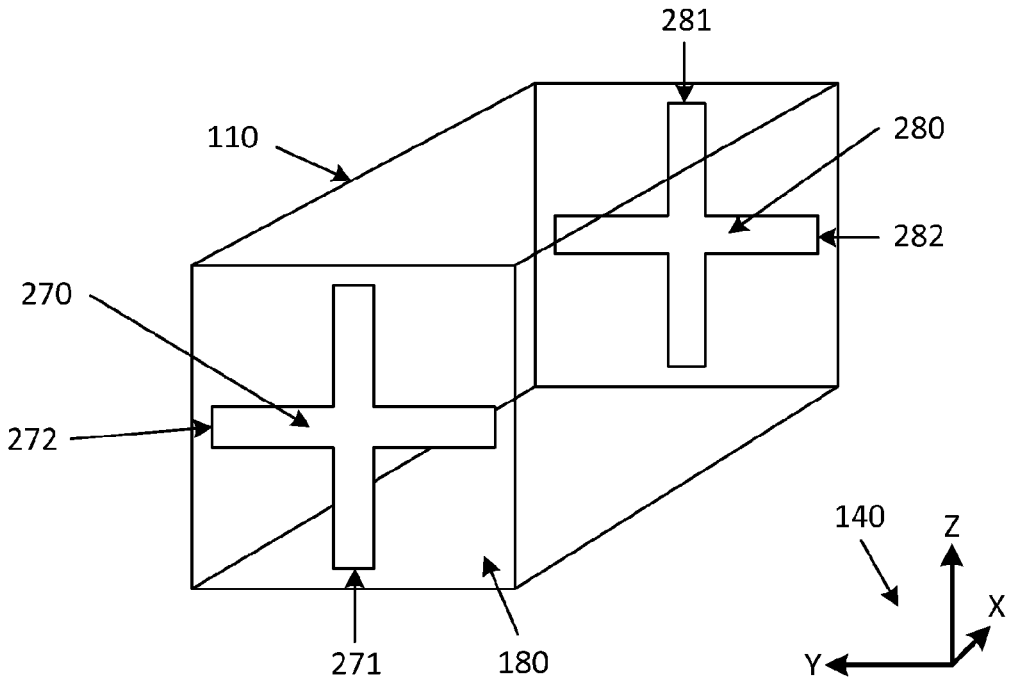
FIG. 8 is a schematic perspective view of a fifth example of a multi-mode filter.

FIG. 8 shows an alternative aperture arrangement, which, in the case shown in FIG. 8, replaces both the input coupling aperture 120 and the output coupling aperture 130, with new, cruciform, apertures. Although input cruciform aperture 270 and output cruciform aperture 280 are shown to be of substantially the same size and orientation as each other, in FIG. 8, this is purely by means of example and other sizes and orientations are possible. It is, optionally, also possible to have differently-shaped input and output coupling apertures, such as a cruciform input coupling aperture 270 and an output L-shaped coupling aperture 130, shown, for example, in FIG. 6.

The operation of the cruciform coupling apertures 270 and 280 in FIG. 8 follow the same principles as previously described in relation to the coupling apertures shown in FIG. 2, although the relative strengths of the coupling achieved to the various resonant modes, within the multi-mode resonator body 110 are typically different from those obtained with above-described aperture shapes, assuming that identical lengths and widths for the vertical and horizontal aperture portions, for example, 121, 122, 271, 272, 281, 282, are used in both cases. This need not, of course, be the case, and different lengths and widths could be used for the aperture portions. This difference in coupling strength is largely due to the very different components of the E and H-fields which would be passed from the outside to the inside of the resonator body 110, via the cruciform aperture or apertures. For example, a centrally-located cruciform coupling aperture will have a strong E-field component, resulting from coupling taking place through its open centre, and will therefore couple strongly to the X mode, however it has a relatively small area (at its ends) located close to the H-field maxima, which occur around the outside of the resonator face 180 when using an input resonator as a means to contain the fields to be coupled into the multi-mode resonator 110. As a consequence, where a cruciform aperture is used, coupling to the Y and Z modes will be weaker than with the coupling structures shown in FIG. 2 or FIG. 7, for example.

In a practical implementation of this cruciform aperture structure, the opposite 'legs' of the cross, for example the part of aperture portion 271 extending vertically upward from the centre of the cross and the part of aperture portion 271 extending vertically downward from the centre of the cross, would need to be different from one another, in either width or length or both. So, for example, the upper vertical section of the aperture portion 271 of the cross would need to be either longer or fatter (or both) than the lower vertical section; this would then ensure that the 'positive' and 'negative' H-field couplings, based upon the direction of the upper portion and lower portion H-field arrows 160 in FIG. 2, would not substantially cancel out, in the horizontal direction. The upper portion H-field arrows 160, in this case, refer to the H-field direction as shown by the H-field arrows 160 located in the upper half of the resonator face 180; the lower portion H-field arrows 160, refer to the H-field direction as shown by the H-field arrows 160 located in the lower half of the resonator face 180. It can be seen from FIG. 2 that these upper and lower arrows point in opposing directions, indicating that the couplings obtained in these two locations would oppose one another and, if identical in strength, would typically entirely cancel each other out.

In the same manner, the left-hand horizontal section of the aperture portion 272 of the cross would need to be either longer or fatter (or both) than the right-hand horizontal section; this would then ensure that the 'positive' and 'negative' H-field couplings would not substantially cancel out, in the vertical direction. The 'positive' and 'negative' couplings referred to above arise, as just described, from the differing, i.e. opposing, directions of the H-field in the upper and lower halves, or the right-hand and left-hand halves, immediately outside of the input face 180 of the multi-mode resonator body 110, in this example. These opposing field directions can be seen clearly in the opposing direction of the H-field arrows 160 in the upper and lower portions, i.e. above and below a notional centre-line through the input face 180, of the multi-mode resonator body 110, shown in FIG. 5.

Figure 9:
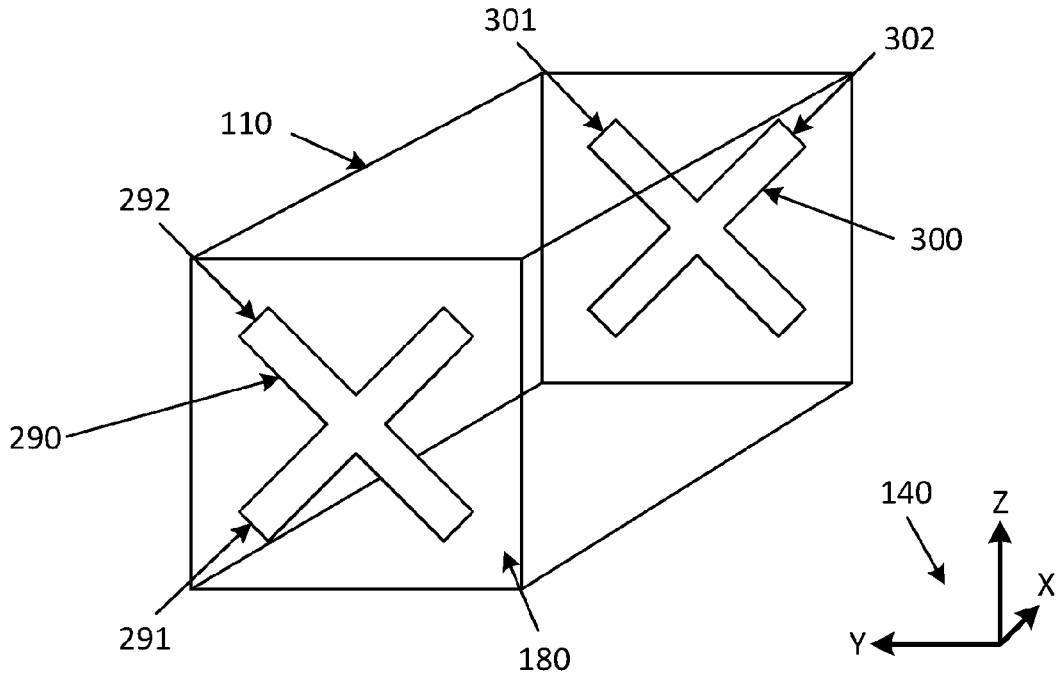
FIG. 9 is a schematic perspective view of a sixth example of a multi-mode filter.

FIG. 9 shows a further alternative input aperture shape 290 and output aperture shape 300 used on the input and output faces of a multi-mode resonator body 110. In FIG. 9, a 'St Andrews' cross aperture shape is shown for both apertures. The operation of the 'St Andrews' cross coupling apertures 290 and 300 in FIG. 9 again follow the same principles as previously described in relation to FIG. 2, although again the relative strengths of the coupling achieved to the various resonant modes, within the multi-mode resonator body 110, are typically different from those obtained with prior aperture shapes, assuming that identical lengths and widths for the vertical and horizontal aperture portions, for example, 121, 122 or left and right-hand slanting portions 291, 292, 301, 302, are used in all cases. This need not, of course, be the case, and different lengths and widths could be used for the aperture portions. This difference in coupling strength is, again, largely due to the very different components of the H-field which would be passed from the outside to the inside of the resonator body 110, via the aperture or apertures. In a practical implementation of this St Andrews cross aperture structure, the opposite 'legs' of the cross, for example the part of aperture portion 291 extending upward, at 45 degrees to the vertical, from the centre of the cross and the part of aperture portion 291 extending downward, at 180 degrees to the first part, from the centre of the cross, would need to be different from one another, in either width or length or both, to prevent undue coupling cancellation from taking place.

Figure 10:
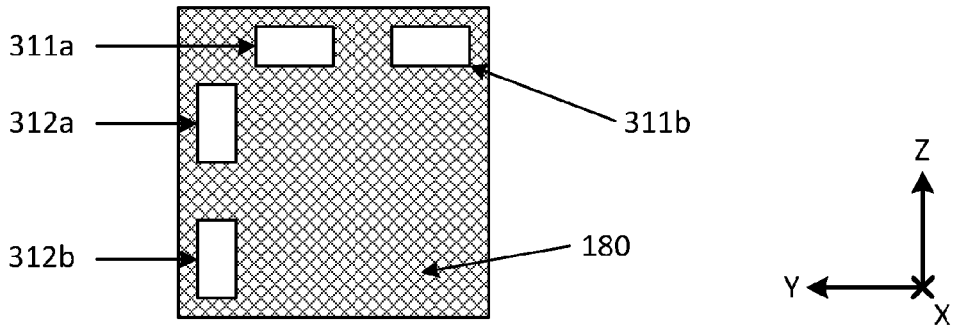
FIGS. 10(*a*) to (*e*) are schematic diagrams of example coupling aperture arrangements for a multi-mode filter.
Figure 10:
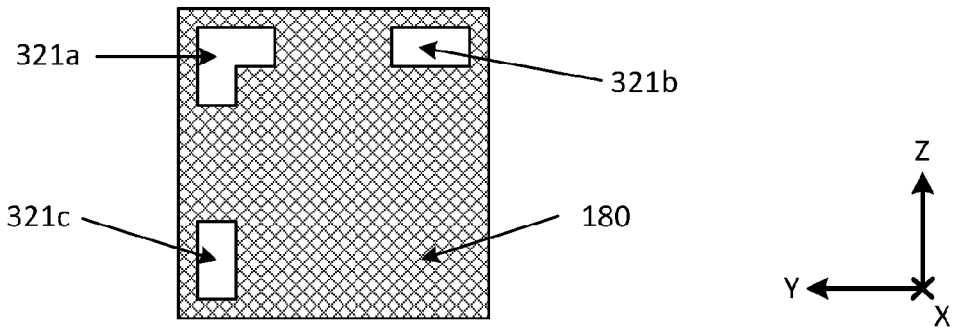
Figure 10:
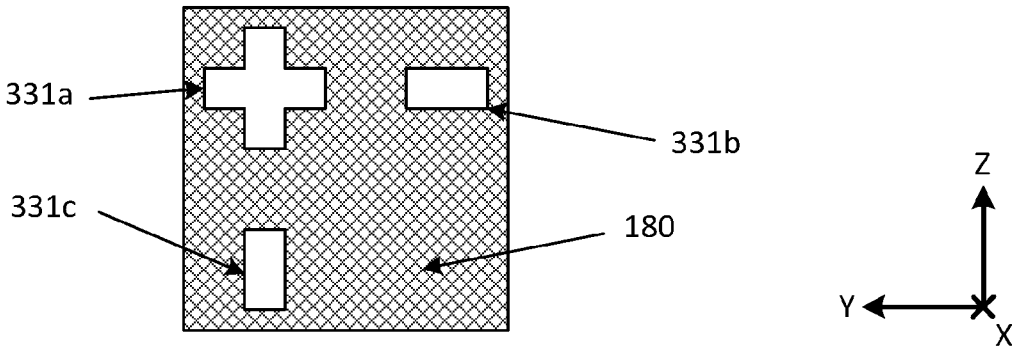
Figure 10:
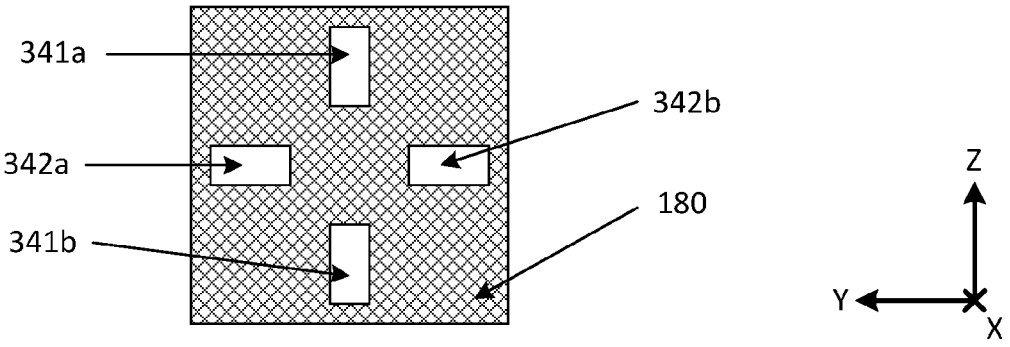
Figure 10:
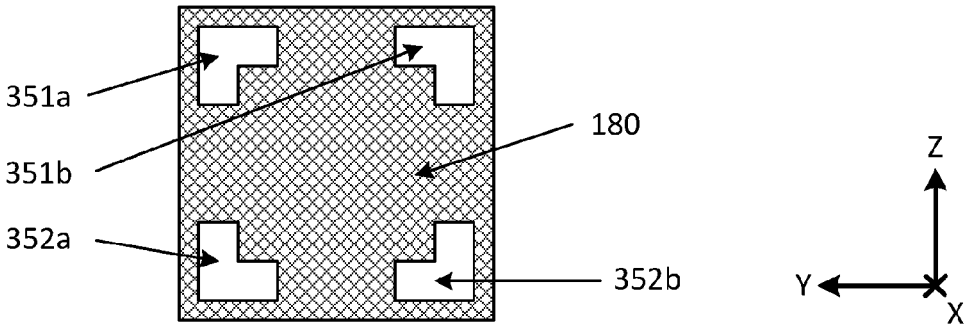

FIG. 10 shows a non-exhaustive range of alternative aperture shapes, according to the present invention, which could be used for either input coupling to the multi-mode resonator 110, for output coupling from the multi-mode resonator 110 or for coupling between multi-mode resonators, in the event that two or more are used in a particular design, for example to meet a particularly demanding filter specification. The alternatives shown in FIG. 10 are: (a) four separate aperture sub-segments, (b) three aperture sub-segments, forming a 'broken right-angle', (c) three aperture sub-segments comprising: a small cross, plus two, orthogonal, slots, (d) a 'broken cross' shaped aperture formed from four separate sub-segments, (e) four corner-shaped apertures. These alternative aperture shapes all operate using the same principles as those described above, with varying relative degrees of coupling to the various modes.

FIGS. 10(*a*), (*b*) and (*c*) will now be discussed together, in more detail, since they are essentially all variants of the same theme. FIG. 10(*a*) shows four separate aperture sub-segments in the form of horizontally-oriented and vertically-oriented 'slots'; these can be thought of as being operationally similar to the aperture coupling structure of FIG. 1(*b*), but with some parts of the aperture 'missing', in other words parts of the metallisation on the face 180 of the multi-mode resonator 110 which had been removed to create the aperture 120, for example, in FIG. 1 are now present, in FIG. 10(*a*), thereby breaking up the original aperture shape into smaller aperture sub-segments 311*a*, 311*b*, 312*a*, 312*b* and entirely omitting some parts, such as the upper left-hand corner of input coupling aperture 120 in FIG. 1(*a*). The aperture form shown in FIG. 10(*a*) will operate in a similar manner, however, to that of FIG. 1(*b*), although it will typically have a somewhat lower degree of E-field coupling to the X-mode, due to the smaller total area occupied by the slots and their location far from the centre of the face 180 of the resonator. The degree of H-field coupling to the Y and Z modes can also decrease, however this does not, typically, occur to the same degree as that of the E-field coupling to the X-mode and this is a significant benefit of this aperture arrangement. It is therefore possible to utilise the aperture arrangement of FIG. 10(*a*) to provide strong H-field coupling to the Y and Z modes, together with strong positive H-field coupling to the X-mode, whilst minimising the amount of negative E-field coupling to the X-mode, which acts to partially cancel the positive coupling to the X-mode arising from the H-field. Minimising the degree of cancellation which occurs in coupling to the X-mode not only enables an appropriate degree of X-mode excitation to be achieved in the multi-mode resonator, to enable it, in conjunction with Y and Z-mode excitation, to meet many filter specifications appropriate in the mobile communications industry, it also helps to minimise the insertion loss of the resulting filter, in its pass-band.

FIG. 10(*b*) now shows the situation in which two of the aperture sub-segments in FIG. 10(*a*) have been moved slightly and merged to form a 'corner' shape 321*a*. Again, the operation of this overall aperture structure, comprising 321*a*, 321*b* and 321*c*, is similar to that of aperture 120 in FIG. 1, but again with typically a lower level of E-field and H-field coupling to all modes than would be obtained from the input coupling aperture 120 shown in FIG. 1(*b*). It would also typically exhibit a different level of coupling to at least some of the various modes, supported within the multi-mode resonator 110, than would be the case with the aperture configuration shown in FIG. 10(*a*), although this difference would usually be less pronounced than that between the aperture shapes and sizes shown in FIG. 1 and FIG. 10(*a*). For example, it is likely that there would exist a lower level of E-field coupling to the X mode when using the aperture configuration shown in FIG. 10(*b*), when compared to that shown in FIG. 10(*a*), due to the reduction in the total cross-sectional area occupied by the coupling aperture sub-segments 321*a*, 321*b*, 321*c* on the face 180 of the multi-mode resonator 110, relative to that of the aperture configuration shown in FIG. 10(*a*), thereby reducing the available area through which the E-field can propagate.

FIG. 10(*c*) shows, in effect, a further shift of the apertures of FIG. 10(*a*), which has now turned the 'corner' 321*a* in FIG. 10(*b*) into a small cross 331*a* in FIG. 10(*c*). This will typically decrease the H-field coupling to the Y and Z modes, relative to that obtained when using the coupling aperture arrangement shown in FIG. 10(*a*), largely due to the fact that the apertures have moved closer to the centre of the face, where the H-fields are weaker.

FIG. 10(*d*) shows four separate aperture sub-segments in the form of horizontally-oriented and vertically-oriented 'slots'; these can be thought of as being operationally similar to the aperture coupling structure of FIG. 8, but with some parts of the aperture missing; in other words parts of the metallisation on the face 180 of the multi-mode resonator 110 which had been removed to create the aperture 270, for example, in FIG. 8 are now present, in FIG. 10(*d*), thereby breaking up the original aperture shape into smaller aperture sub-segments 341*a*, 341*b*, 342*a*, 342*b* and entirely omitting some parts, such as the centre of the coupling aperture 270 in FIG. 8. The aperture form shown in FIG. 10(*d*) will operate in a similar manner, however, to that of FIG. 8, although it will typically have a lower degree of coupling to all modes, due to the smaller total area occupied by the slots. In particular, the lack of a central segment will typically significantly reduce the degree of E-field coupling to the X-mode, since the centre of the face 180 of the multi-mode resonator 110 is typically the location of maximum strength for the E-field, in the case of the overall resonator structure shown in FIG. 6.

FIG. 10(*e*) shows four separate aperture sub-segments in the form of corner segments 351*a*, 351*b*, 352*a* and 352*b*. The aperture form shown in FIG. 10(*e*) will follow the same principles of operation as for the other aperture arrangements discussed above and will typically couple well to the circulating H-field and less well to the E-field, since the centre of the face 180 of the multi-mode resonator 110 is typically the location of maximum strength for the E-field, in the case of the overall resonator structure shown in FIG. 6.

In the case of FIG. 10(*d*) it will typically be necessary to ensure that the upper portion 341*a* and lower portion 341*b* of the coupling apertures are not equal in size and location and, in addition, that the left-hand portion 342*a* and right-hand portion 342*b* of the coupling apertures are also not equal in size and location. This is to ensure that the Y coupling having one sign, say 'positive', resulting from aperture sub-segment 341*a* is not entirely or largely cancelled by a coupling having the opposite sign, 'negative' in this example, arising from aperture sub-segment 341*b*. Likewise, in respect of the left-hand portion 342*a* and right-hand portion 342*b* of the coupling apertures, it is to ensure that the Z coupling having one sign, say 'positive', resulting from aperture sub-segment 342*a* is not entirely or largely cancelled by a coupling having the opposite sign, 'negative' in this example, arising from aperture sub-segment 342*b*. An analogous situation also exists, for the vertical and horizontal portions of the aperture sub-segments 351*a*, 351*b* and 352*a*, 352*b* of FIG. 10(*e*).

Whilst the discussion of aperture-based coupling, above, has concentrated on specific, predominantly rectilinear, aperture shapes, there are many other possible aperture shapes, which would also obey similar principles of operation to those described. Examples of suitable aperture shapes include, but are not limited to: circles, squares, ellipses, triangles, regular polygons, irregular polygons and amorphous shapes. The key principles are: i) to enable coupling to, predominantly, the X-mode within a multi-mode resonator, by means of an E-field existing adjacent to, but outside of, the said multi-mode resonator, where the degree of coupling obtained is based upon the aperture area or areas and the aperture location or locations on the face of the said multi-mode resonator; and ii) to enable coupling to the Y and Z modes within a multi-mode resonator, by means of an H-field existing adjacent to, but outside of, the said multi-mode resonator, where the degree of coupling obtained is based upon the aperture area or areas and the aperture location or locations on the face of the said multi-mode resonator, wherein the mode (Y or Z) to be predominantly coupled to is based upon the horizontal (for the Z-mode) or vertical (for the Y-mode) extent of the coupling aperture or apertures and its (or their) locations relative to the centre of the face of the said multi-mode resonator.

A common application for filtering devices is to connect a transmitter and a receiver to a common antenna, and an example of this will now be described with reference to FIG. 11(*a*). In this example, a transmitter 951 is coupled via a filter 900A to the antenna 950, which is further connected via a second filter 900B to a receiver 952. Filters 900A and 900B could be formed, for example, utilising the resonator arrangement shown in FIG. 6, with the addition of a suitable arrangement to couple energy into input resonator 190 and a second arrangement to couple energy from output resonator 200. An example of a suitable arrangement for either or both of coupling energy into input resonator 190 and coupling energy from output resonator 200 would be the use of a probe, in each case and this approach is described in more detail below, in conjunction with FIG. 13.

Figure 11:
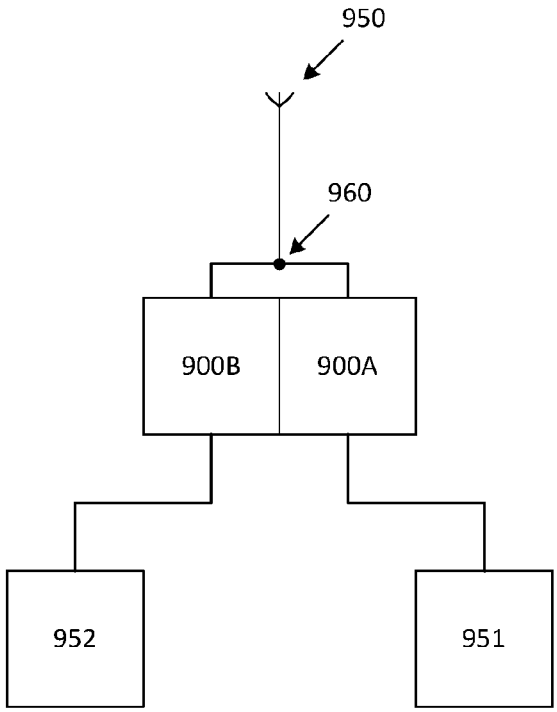
FIG. 11(*a*) is a schematic diagram of an example of a duplex communications system incorporating a multi-mode filter.
Figure 11:
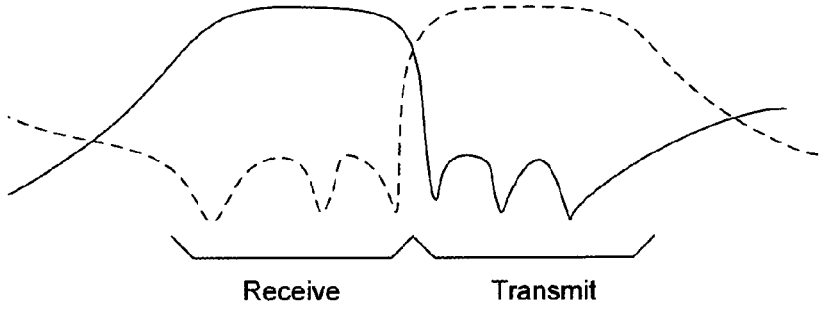

In use, the arrangement shown in FIG. 11(*a*) allows transmit power to pass from the transmitter 951 to the antenna 950 with minimal loss and to prevent the power from passing to the receiver 952. Additionally, the received signal passes from the antenna 950 to the receiver 952 with minimal loss.

An example of the frequency response of the filter is as shown in FIG. 11(*b*). In this example, the receive band (solid line) is at lower frequencies, with zeros adjacent the receive band on the high frequency side, whilst the transmit band (dotted line) is on the high frequency side, with zeros on the lower frequency side, to provide a high attenuation region coincident with the receive band. It will be appreciated from this that minimal signal will be passed between bands. It will be appreciated that other arrangements could be used, such as to have a receive pass band at a higher frequency than the transmit pass band.

Figure 12:
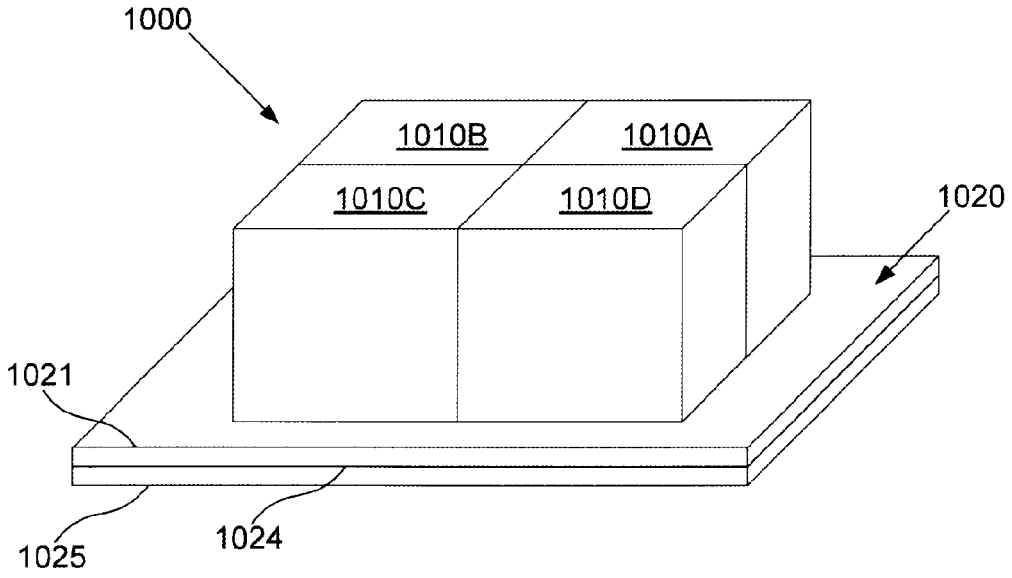
FIG. 12 is a schematic perspective view of an example of a multi-mode filter using multiple resonator bodies to provide filtering for transmit and receive channels.

It will be appreciated that the filters 900A, 900B can be implemented in any suitable manner. In one example, each filter 900A and 900B includes two resonator bodies provided in series, with the four resonator bodies mounted on a common substrate, as will now be described with reference to FIG. 12.

In this example, multiple resonator bodies 1010A, 1010B, 1010C, 1010D can be provided on a common multi-layer substrate 1020, thereby providing transmit filter 900A formed from the resonator bodies 1010A, 1010B and a receive filter 900B formed from the resonator bodies 1010C, 1010D.

Accordingly, the above described arrangement provides a cascaded duplex filter arrangement. It will be appreciated however that alternative arrangements can be employed, such as connecting the antenna to a common resonator, and then coupling this to both the receive and transmit filters. This common resonator performs a similar function to the transmission line junction 960 shown in FIG. 11(*a*).

Figure 13:
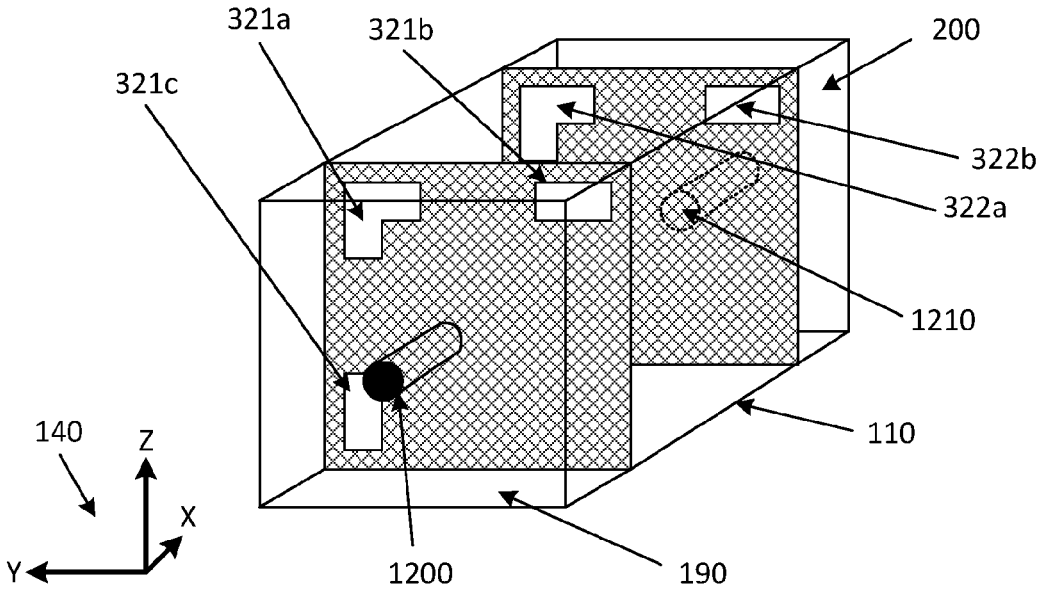
FIG. 13(*a*) is a schematic perspective view of an example multi-mode filter incorporating input and output coupling probes.
Figure 13:
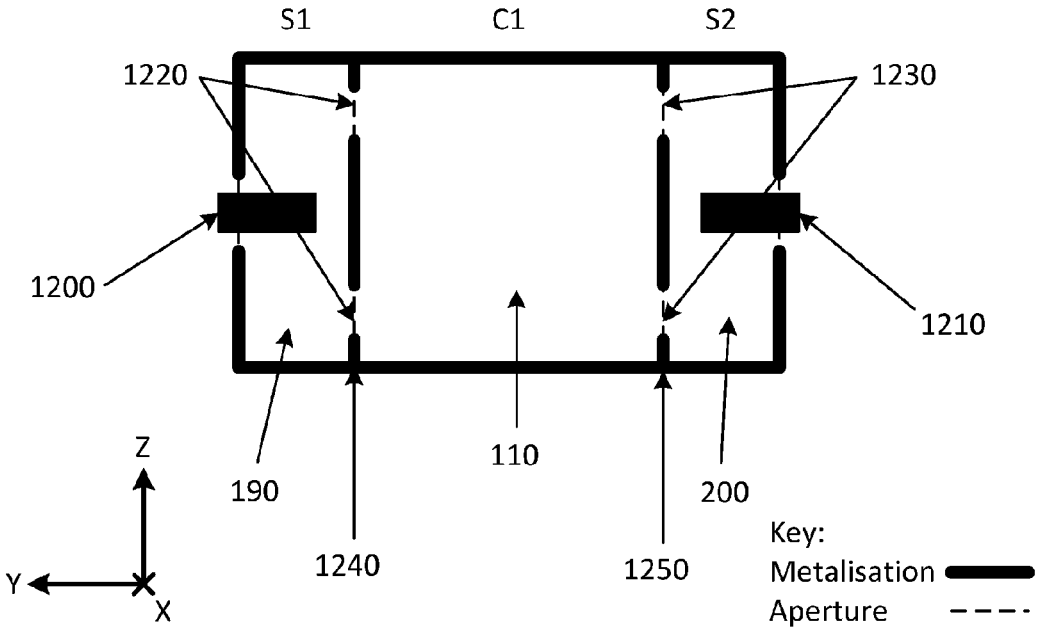

FIG. 13(*a*) illustrates the use of coupling probes 1200, 1210 to feed signals into the input single-mode resonator 190 and to extract signals from the output single-mode resonator 200. The structure shown is similar to that shown in FIG. 6, however, in the case of FIG. 13, the coupling aperture 120 has been replaced by three aperture sub-segments, 321*a*, 321*b* and 321*c*. These aperture sub-segments, together with their operation, have been previously described with reference to FIG. 10(*b*). The output coupling aperture 130 of FIG. 6 has, likewise been replaced by three sub-segments, only two of which can be seen in the perspective view shown in FIG. 13(*a*); those being: aperture sub-segments 322*a* and 322*b*.

FIG. 13(*b*) illustrates a side-view of the filter arrangement shown in FIG. 13(*a*). The input coupling probe 1200 can be seen to penetrate significantly into the input single-mode resonator 190; likewise, the output coupling probe 1210 can be seen to penetrate significantly into the output single-mode resonator 200. The degree of probe penetration employed for either the input coupling probe 1200 or the output coupling probe 1210 is a design decision and depends upon the precise filter characteristics which are required in the application for which the filter is being designed. Penetration depths ranging from no penetration at all, where the probe just touches the outer face of the input single-mode resonator 190, for example, to full penetration, where the probe extends to the front face of the multi-mode resonator 110, which may or may not be metallised, for example due to the location of the input coupling apertures 1220. An analogous situation exists at the output of the filter, for the penetration depth of the output coupling probe 1210 within the output single-mode resonator 200. Here, again, the output coupling apertures 1230 may be located centrally or peripherally, or both, on the output face 1250 of the multi-mode resonator 110, meaning that a fully-penetrating probe may or may not contact the metallisation surrounding the multi-mode resonator 110.

Figure 14:
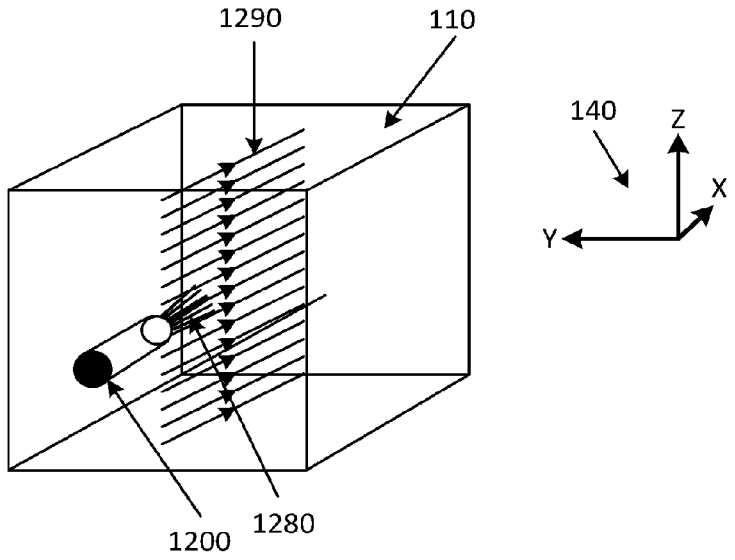
FIG. 14(*a*) is a schematic perspective view of an example of a resonator with probe-based excitation.
Figure 14:
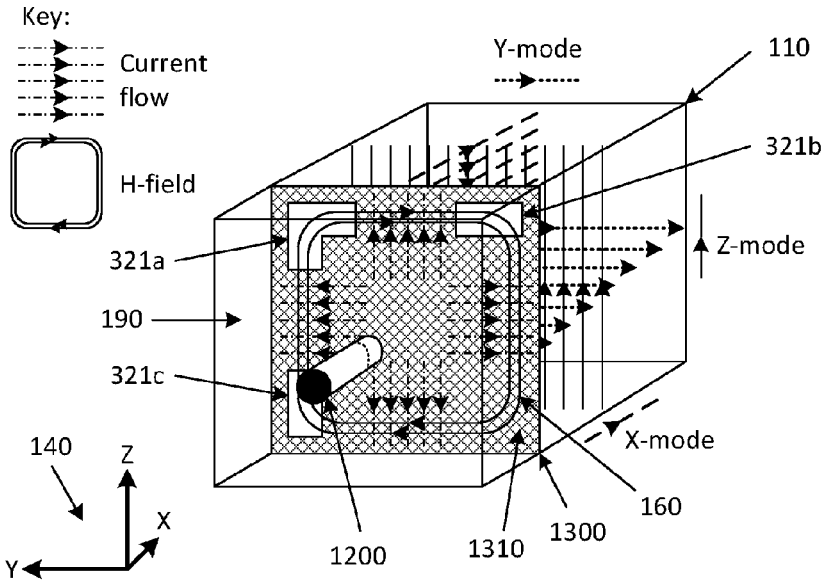
Figure 14:
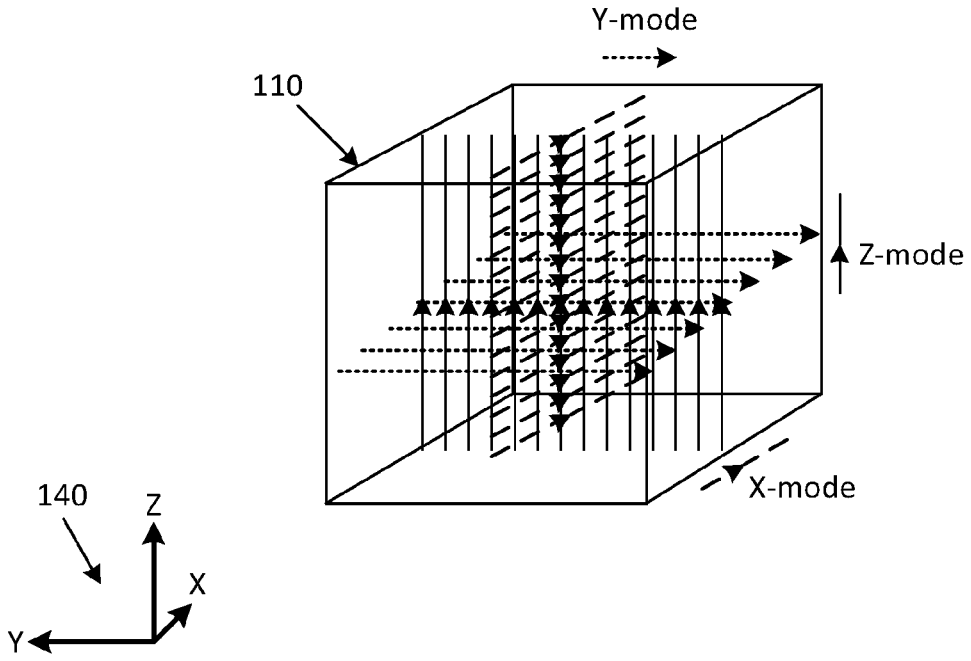

As has been discussed briefly above, the input single mode resonator 190 and the output single mode resonator 200 operate to transform the predominantly E-field generated by the input coupling probe 1200 from a largely E-field emission into an E and H-field structure, which can then be used, in turn, to simultaneously excite two or more of the modes of the multi-mode resonator 110. This situation is illustrated in FIG. 14.

These are two key advantages to the use of single mode resonators, together with probes or another suitable field excitation mechanism, such as patches or loops, as a means for exciting or extracting energy from multiple modes simultaneously, in a multi-mode resonator based filter structure:

1. The addition of single-mode resonators enables an input signal connection mechanism or coupling structure which is, of itself, incapable of exciting multiple modes simultaneously (in this case, a probe), to be used to excite multiple modes simultaneously in a multi-mode resonator, without recourse to additional measures, such as the addition of defects to the multi-mode resonator.

2. The addition of single-mode resonators provides additional filtering to assist in, for example, removing out of band products or to improve the cut-off performance immediately adjacent to the wanted pass-band. In the case of two added single-mode resonators, one at the input to the system and one at the output, two single-mode filters are, in effect, added to the existing triple mode filter. These can significantly improve the overall filtering performance.

It is notable that FIG. 13(*a*) (and also FIG. 6) depicts input and output single-mode resonators, 190, 200, which are smaller, i.e. thinner, than the multi-mode resonator 110. This depiction is deliberate, since the thickness of the single-mode resonators is typically an important design parameter in achieving a good overall filter specification.

The input and output single-mode resonators will typically possess both wanted and unwanted resonances and it is important to place the one or more unwanted resonances at frequencies where they may be reduced or removed simply and with the introduction of minimal additional losses, in effecting their removal. One way to achieve this goal is to ensure that the Y and Z-dimensions as defined in FIG. 13(*a*), of the input resonator, say, are designed such that the first two resonant modes of that resonator are arranged as follows: The first resonant mode is placed within the wanted pass-band of the overall filter; in this way it can provide additional, useful, filtering as discussed above. The second resonant mode is then, partially as a consequence of locating the first within the filter pass-band, placed as far as possible from the pass-band and is typically located at a frequency which is approximately 1.6 times the centre frequency of the pass-band, if the Y and Z dimensions are arranged to be approximately equal to each other. Thus, for example, a filter with a pass-band centre frequency designed to be at 1.8 GHz will have an unwanted resonance and hence an unwanted reduction in the stop-band attenuation, resulting from the input resonator, at approximately 2.88 GHz. This unwanted resonance can then be reduced or removed by means of a separate, cascaded, filter, which could be in the form of a low-pass, a band-pass or a notch filter.

Note that an analogous situation to that described above, in respect of the input resonator, also exists for the output resonator and it, too, will therefore, typically, be thinner, i.e. smaller in the X-dimension, than will the multi-mode resonator and it may be of the same dimensions as the input resonator.

The above-discussed ability to provide a wide separation between the wanted and spurious resonances of both the input and output resonators is an advantage over alternative, conductive-track based coupling structures, designed to excite multiple modes simultaneously within a multi-mode resonator. In the case of conductive-track based coupling structures, it is generally not desirable to place the first resonant mode within the overall filter's pass-band, since the Q of this first resonant mode will be relatively poor and consequently it will degrade some or all of the pass-band characteristics of the overall filter. It will not, as was the case with input or output resonant cavities, provide useful additional filtering, indeed quite the reverse will be the case. It is therefore typically necessary to place the first resonant mode of the track-based coupling structure below the filter pass-band and the second resonant mode will therefore typically appear above the pass-band. Whilst it is possible to reduce or remove these additional spurious resonances, by means of an additional band-pass filter, for example, such a filter would need to have good roll-off performance characteristics and would therefore, typically, introduce excessive, unwanted, losses in the overall filter's pass-band. It is one of the aims of the present invention to realise a low-loss, high-performance, filter and consequently such additional losses are generally unacceptable.

FIG. 14(*a*) shows the situation in which an input coupling probe 1200 is directly inserted into a dielectric-filled, externally-metallised, cavity 110 which would ordinarily be capable of supporting multiple modes simultaneously, based upon its shape, dimensions and the material from which it is constructed. In this case, however, an input single-mode resonator is not used (the probe being directly inserted in to the multi-mode-capable cavity) and no defects are applied to the cavity, such as holes or corner-cuts being imposed upon the dielectric material. In other words, a cavity 110 which it is desired to be resonant in two or more modes and with a shape suitable to support such a diversity of modes is attempting to be directly excited by a probe 1200, without further assistance. In this case, the probe generates substantially an E-field; unsurprising since its primary characteristic is that of an E-field emitting device. This E-field will then excite a single mode in the main resonator—with the axes as defined in FIG. 14(*a*), this is the X-mode. Without the use of additional defects in the main resonator, such as corners milled off the cuboidal resonator shape, additional, undriven, probes or screws inserted into the resonator at carefully designed locations or some other means, it is not typically possible for the probe to excite significant (i.e. useful, from a high-performance filtering perspective) resonances in either of the other two modes, Y or Z. Note that in FIG. 14(*a*), the E-field emission from the far end of the probe is shown in an indicative manner and is not intended to be an accurate representation of the precise E-field generated by the probe. Note also that it is assumed that the resonator cavity 110 would be metallised on all surfaces, barring, possibly, a small area surrounding the input probe 1200, depending upon its design, although such metallisation is omitted from FIG. 14(*a*), for clarity.

FIG. 14(*b*) shows the situation in which an input coupling probe 1200 is now inserted into a single-mode dielectric resonator 190, which is in turn coupled to a multi-mode resonator 110 by some means; this means being apertures, in the case of FIG. 14(*b*), although other possibilities exist, such as etched tracks, patches and other structures. Note that in this figure, as in FIG. 14(*a*), only an input coupling mechanism is shown—a typical practical filter design would also require a separate output coupling mechanism, as shown, for example, in FIG. 13.

FIG. 14(*b*) illustrates, in detail, the primary fields, currents and excited modes present within the design, although not all fields are shown, to aid clarity. Note that the fields shown are representational only, and do not accurately convey the shape of the fields within the multi-mode resonator; this figure is intended to show the relative directions of the modes and not their shapes. For example, the E-fields present within the resonator will fall to a minimum and ideally, zero, at the metallised walls of the resonator, for the modes in which the E field is parallel to the wall. The single mode resonant cavity 190 takes the energy from the E-field generated by the input probe and this predominantly excites a single resonant mode within the cavity; with the arrangement shown, this would typically be the X-mode of the single-mode resonant cavity 190. This mode will typically, in turn, induce currents in the metallisation 1310 on the interface 1300 between the single and multi-mode resonators; these currents are shown by means of the dash-dot arrows in FIG. 14(*b*). This process will also typically generate an H-field 160, which can circulate, as shown in FIG. 14(*b*), and can have a greater intensity toward the outside of the resonator and a lower intensity closer to the centre. Finally, an E-field (not shown in FIG. 14(*b*), although it is highlighted 170 in FIG. 2), will typically be generated, which will generally be aligned parallel to the shorter edges of the single-mode resonator 190, in other words, in parallel with the extruded direction of the probe.

FIG. 14(*c*) is a version of FIG. 14(*b*) with the input resonator, probe and metallisation removed, to allow the field directions to be seen more easily. As above, the fields shown are representational only, and do not accurately convey the shape of the fields within the multi-mode resonator; this figure is intended to show the relative directions of the modes and not their shapes. For example, the E-fields present within the resonator will fall to a minimum and ideally, zero, at the metallised walls of the resonator, for the modes in which the E field is parallel to the wall.

From these currents and fields, all available fundamental modes of the multi-mode resonator 110 may be excited, simultaneously, as follows. The E-field can propagate through the aperture sub-sections 321*a*, 321*b*, 321*c*, in a direction perpendicular to the plane of the apertures, and will excite the X-mode within the main resonator. The horizontal component of the H-field 160 can be coupled by the upper, horizontally-aligned, parts of the coupling aperture sub-sections 321*a* and 321*b* and this will typically couple, predominantly, to the Z-mode in the multi-mode resonator. Finally, the vertical component of the H-field 160 can be coupled by the left-most, vertically-aligned, parts of the coupling apertures sub-sections 321*a* and 321*c*, and this will typically predominantly couple to the Y-mode in the multi-mode resonator 110. In addition to coupling to the Y and Z-modes, the H-field 160 will also, typically, couple to the X-mode in the multi-mode resonator 110, but generally in the opposite sense to the X-mode excitation resulting directly from the E-field. These two mechanisms for coupling to the X-mode, namely that arising from the E-field present in the input single-mode resonator 190 and that arising from the H-field present in the input single-mode resonator 190, can act in opposition to one another and the weaker coupling effect can, therefore, partially cancel the effect of the stronger coupling effect. It is the resultant of this cancellation process which largely determines the amount of the X-mode present in the multi-mode resonator 110.

In this manner, all supported modes in the multi-mode resonator 110 may be excited simultaneously by means of a single probe, with no defects typically being required to any of the resonators within the design.

Figure 15:
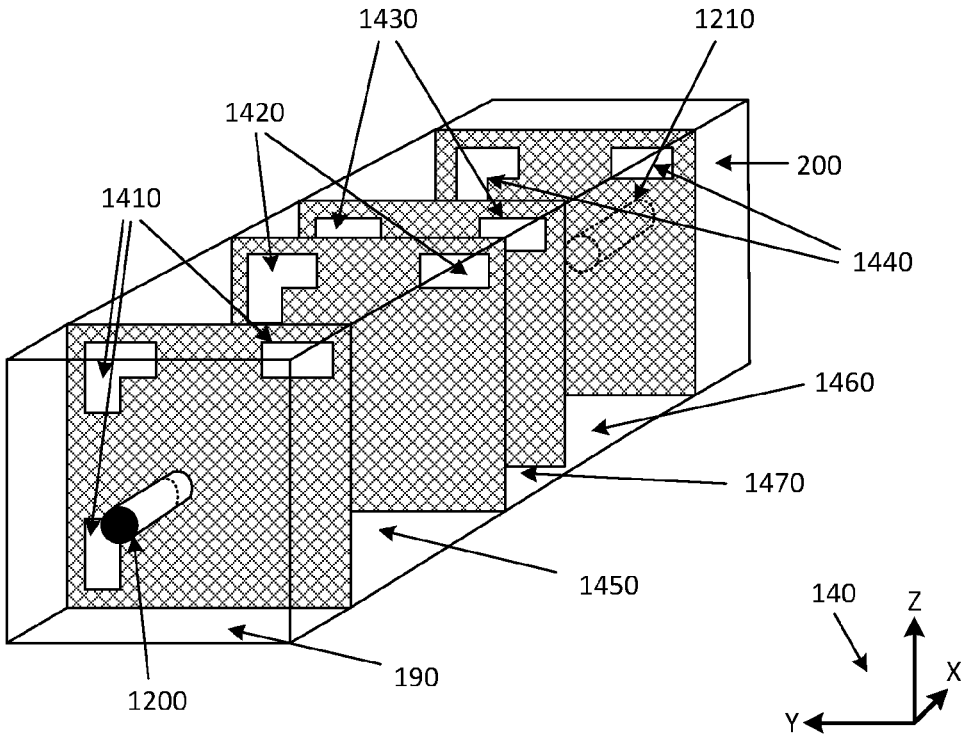
FIG. 15 is a schematic perspective view showing a further example of a multi-mode filter.

Some filter specifications are particularly demanding, for example in terms of the steepness of their pass-band-to-stop-band roll-off characteristics and consequently a single multi-mode resonator, even with the addition of its associated input and output single-mode resonators, and consequently their filtering characteristics, is not sufficient to meet the specified requirements. In such circumstances, an additional multi-mode resonator may be employed, within the cascade of resonators. This second multi-mode resonator may be made to the same design, shape and dimensions and be made of the same material, as the first multi-mode resonator, or it may be different in one or more of these areas. However it is configured or fabricated, it must able to extract energy from the prior element in the filter cascade and supply energy to the subsequent element in the filter cascade, with as lower level of losses as possible. FIG. 15 illustrates one option for configuring such a filter: that of employing a further single-mode resonator 1470 located between the two multi-mode resonators 1450, 1460, in the centre of a filter cascade. The purpose of this further single-mode resonator 1470 is to facilitate coupling from a first multi-mode resonator to a second multi-mode resonator, in a simple and straightforward manner. The remainder of the filter is similar, in arrangement to FIG. 13(*a*), having an input single-mode resonator 190, an output single-mode resonator 200, each fed by respective probes 1200, 1210 and each using coupling apertures 1410, 1440 to provide excitation to or extract energy from an adjacent multi-mode resonator 1450, 1460.

The operation of the filter is also similar to that of FIG. 13(*a*), in particular regarding the use of the input and output probes, input and output single-mode resonators and their associated coupling apertures. These aspects will, therefore, not be described further. The main area of difference lies in the use of a further single-mode resonator 1470 to facilitate the coupling of multiple modes from a first multi-mode resonator 1450 to a second multi-mode resonator 1460. The process of coupling takes place, typically, as follows. The first multi-mode resonator 1450, whose multiple resonant modes have undergone excitation via the input apertures 1410, may have that energy largely extracted via coupling apertures 1420 in a similar manner as has already been described in relation to coupling aperture 130 of FIG. 6. The energy contained in the multiple modes of the first multi-mode resonator 1450 will thereby largely pass into the single-mode resonator 1470, in the form of a single-mode excitation. This single-mode excitation can then largely excite multiple modes in a second multi-mode resonator 1460, via coupling apertures 1430. Again, the excitation mechanisms, in this case, are similar to those described previously in relation to aperture 120 in FIG. 6 and apertures 321*a*, 321*b*, 321*c* of FIG. 14(*b*). Single-mode resonator 1470 is therefore acting as both an output single-mode resonator for the first multi-mode resonator 1450 and as an input single-mode resonator for the second multi-mode resonator 1460. Coupling from a first multi-mode resonator to a second multi-mode resonator may therefore be facilitated by the use of a single, single-mode resonator placed between the two. Likewise, by extension, multiple, multi-mode resonators may be coupled together by means of a single, single-mode resonator being placed between adjacent multi-mode resonators.

The use of intervening single-mode resonators, between multi-mode resonators, as just described, enables a high degree of control to be provided of the mode-to-mode coupling between the multi-mode resonators. This is more difficult to achieve with direct multi-mode resonator to multi-mode resonator coupling, which will be discussed in more detail below, with reference to FIG. 17.

Figure 16:
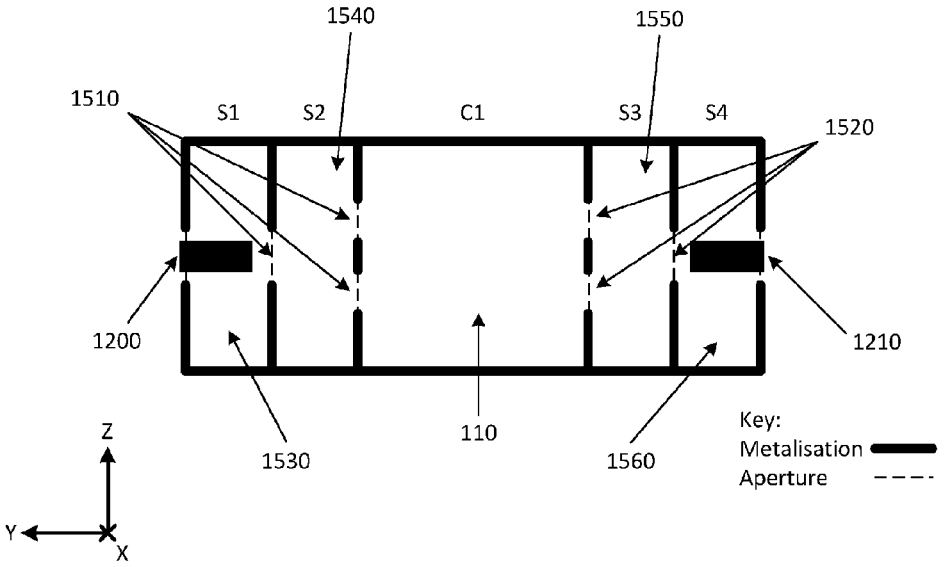
FIG. 16 is a schematic diagram showing a side view of an example multi-mode filter incorporating input and output coupling probes.

FIG. 16 illustrates the use of two single-mode resonators 1530, 1540 and 1550, 1560 on both the input and output of a single multi-mode resonator 110. The primary purpose of adding a second single-mode resonator to either the input of the output or both is to create an additional zero in the filter characteristic, which can be tuned or placed such that it can remove certain out-of-band spurious responses from the overall filter characteristic. Furthermore, these additional single-mode resonators will also provide additional filtering capability, in the same way as for the single input and output single-mode resonators discussed in relation to FIG. 13.

Figure 17:
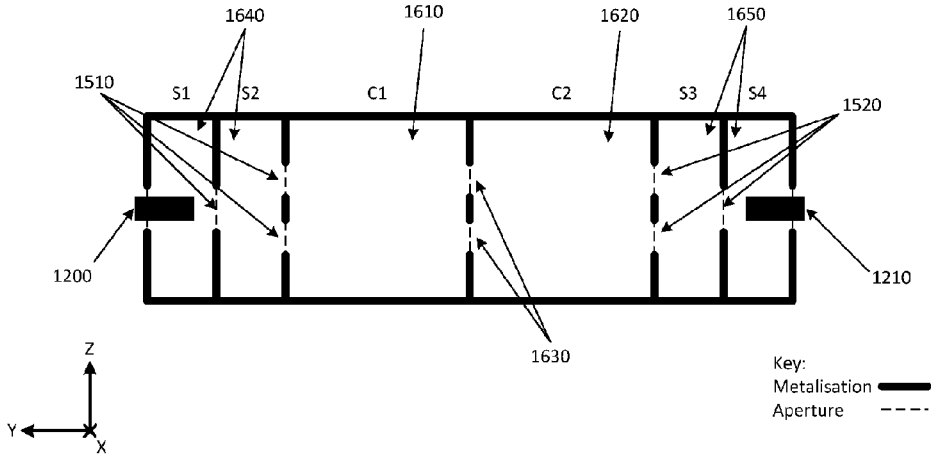
FIG. 17 is a schematic diagram showing a side view of an example multi-mode filter incorporating input and output coupling probes and two multi-mode resonators.

FIG. 17 shows the use of pairs of single-mode resonators 1640, 1650 on both the input and output of a multi-mode resonator filter, however in this case, two multi-mode resonators are shown in cascade, with direct coupling from a first multi-mode resonator 1610 to a second multi-mode resonator 1620. This contrasts with the configuration shown in FIG. 15, in which an intervening single-mode resonator 1470 was used to facilitate multi-mode resonator to multi-mode resonator coupling. Whilst it is, typically, more difficult to control direct multi-mode to multi-mode resonator coupling, to the required degree to meet some demanding filter specifications, it is, however, suitable for others.

Figure 18:
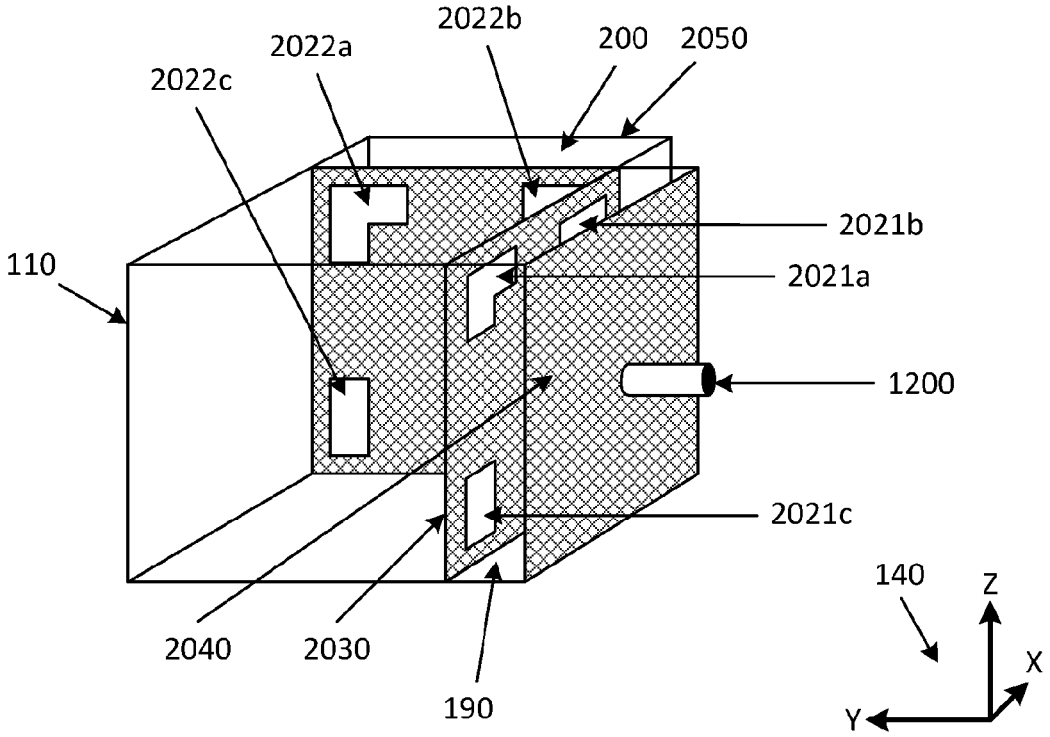
FIG. 18 is schematic perspective view showing a further example of a multi-mode filter.

All of the examples shown and discussed so far have been in the form of linear cascades of dielectric resonators. It is not, however, essential that all embodiments of a multi-mode filter, according to the present invention, are arranged as a linear cascade. Multiple modes within a multi-mode resonator can typically be excited via any one of a number of faces, or any face, of the multi-mode resonator, by the provision of one or more suitably-designed apertures on that face or faces and the provision of a suitable electromagnetic field adjacent to the apertures, to provide the source of the excitation. As an example of an alternative arrangement, to illustrate this general principle, FIG. 18 shows a three-resonator filter with input and output coupling resonators 190, 200, appearing on perpendicular faces of a multi-mode resonator 110. This is an analogous configuration to that shown earlier in FIG. 13(*a*). An arrangement of resonators, such as that shown in FIG. 18, may typically be advantageous in a duplexer application, since such an arrangement could allow the transmit and receive ports to be spatially separated to the maximum degree possible, for a given number of resonators employed within each of the transmit and receive filters.

Note that, as in FIG. 13(*a*) most of the metallisation surrounding the resonators has been omitted in FIG. 18, to enable the various coupling apertures and the basic structure of the multi-resonator filter to be seen more clearly. A practical filter would typically feature metallisation substantially covering all faces of each of the resonators forming the filter, with metallisation removed or omitted to form the apertures.

The operation of the filter shown in FIG. 18 is analogous to that of FIG. 13*a*, although the precise design of the aperture shape or shapes, sizes, orientations or locations on the input face 2030 of the multi-mode resonator 110 may be different. An input signal, connected to input probe 1200, can excite one or more modes in input resonator 190. The one or more modes present in input resonator 190 may, in turn, excite multiple modes within the multi-mode resonator 110, via one or more of apertures 2021*a*, 2021*b* and 2021*c*. The multiple modes present within the multi-mode resonator 110 may be extracted, via one or more of apertures 2022*a*, 2022*b* and 2022*c* and thereby excite one or more modes within output resonator 200. Finally, signals may be extracted from output resonator 200 by means of a probe (not shown) which is located in close proximity to, touches or penetrates the output face 2050 of the output resonator 200.

The above described examples have focused on coupling to up to three modes. It will be appreciated this allows coupling to be to low order resonance modes of the resonator body. However, this is not essential, and additionally or alternatively coupling could be to higher order resonance modes of the resonator body.

Persons skilled in the art will appreciate that numerous variations and modifications will become apparent. All such variations and modifications which become apparent to persons skilled in the art are considered to fall within the spirit and scope of the invention broadly appearing before described.

The invention claimed is:

1. A multi-mode cavity filter comprising:

a first resonator body comprising a first piece of dielectric material, the first piece of dielectric material having a cuboidal shape such that it can support a first resonant mode and at least a second substantially degenerate resonant mode;

a second resonator body positioned adjacent to the first dielectric resonator body, the second resonator body comprising a second piece of dielectric material, the second piece of dielectric material having a cuboidal shape such that it can support at least a resonant mode substantially degenerate with the first resonant mode of the first resonator body; and at least one layer of electrically conductive material in contact with and covering the first and second resonator bodies, the at least one layer of electrically conductive material extending along an interface between the first and second resonator bodies, the interface being between opposing faces of the first and second resonator bodies, and the faces having multiple edges;

wherein the filter further comprises at least one aperture in the at least one layer of electrically conductive material at said interface, the at least one aperture being adjacent to at least one edge of the multiple edges of the faces and not extending to a geometric centre of the faces, and being arranged for transferring signals between the first resonator body and the second resonator body, the at least one aperture being further arranged for directly coupling signals, in parallel, between the first resonant mode and the second substantially degenerate resonant mode within the first resonator body and the resonant mode within the second resonator body.

2. The multi-mode cavity filter according to claim 1, wherein the at least one aperture at the interface is elongated along a direction substantially parallel to a surface of the body.

3. The multi-mode cavity filter according to claim 1, wherein the at least one aperture comprises at least a first aperture and a second aperture, the first aperture being primarily for coupling to the first resonant mode and the second aperture being primarily for coupling to the second resonant mode.

4. The multi-mode cavity filter according to claim 1, wherein the first piece of dielectric material supports a third resonant mode substantially degenerate with the first and second resonant modes supported by the first piece of dielectric material, wherein the first, second and third resonant modes are mutually orthogonal, and wherein the at least one aperture comprises at least a first aperture and a second aperture, the first aperture being primarily for coupling to the first and third resonant modes and the second aperture being primarily for coupling to the second and third resonant modes.

5. The multi-mode cavity filter according to claim 1, wherein an aperture of the at least one aperture comprises one of a slot or other straight sided shape, an amorphous shape, a curved shape and a symmetrical shape.

6. The multi-mode cavity filter according to claim 1, wherein the second piece of dielectric material has a shape such that it cannot support another substantially degenerate resonant mode.

7. The multi-mode cavity filter according to claim 1, wherein the first piece of dielectric material comprises a substantially planar surface forming the face of the first resonator body, and wherein the second piece of dielectric material comprises a substantially planar surface forming the face of the second resonator body, the substantially planar surface of the second piece of dielectric material for mounting to the substantially planar surface of the first piece of dielectric material.

8. The multi-mode cavity filter according to claim 1, further comprising:

a third resonator body positioned adjacent to the first resonator body, the third resonator body comprising a third piece of dielectric material, the third piece of dielectric material having a cuboidal shape such that it can support at least a first resonant mode substantially degenerate with the first resonant mode of the first resonator body; and wherein the at least one layer of electrically conductive material is further in contact with and covers the third resonator body, and extends along a second interface between the first and third resonator bodies, the interface between opposing faces of the first and third resonator bodies, the faces having multiple edges;

wherein the filter further comprises at least one other aperture in the at least one layer of electrically conductive material at said second interface, the at least one other aperture adjacent to at least one edge of the multiple edges of the faces of the first and third resonator bodies and being arranged for transferring signals between the first resonator body and the third resonator body, the at least one other aperture being further arranged for directly coupling signals, in parallel, between the first resonant mode and the second resonant mode within the first resonator body and the first resonant mode within the third resonator body.

9. The multi-mode cavity filter according to claim 1, wherein the at least one aperture comprises a void in the at least one layer of electrically conductive material.

10. The multi-mode cavity filter according to claim 1, wherein the first resonator body is formed from the dielectric material, and wherein the second resonator body is formed from the dielectric material.

11. The multi-mode cavity filter according to claim 1, wherein at least one aperture at the interface is elongated along a direction parallel with a magnetic field of one of said modes.

12. The multi-mode cavity filter according to claim 11, wherein the at least one aperture comprises first and second apertures, the first aperture at the interface is elongated along a first direction parallel with a magnetic field of one of said modes and the second aperture at the interface is elongated along a second direction parallel with a magnetic field of another of said modes.

13. The multi-mode cavity filter according to claim 1, wherein the at least one aperture comprises an aperture having first and second limbs, the first limb being elongated along a first direction parallel with a magnetic field of the first resonant mode and the second limb being elongated along a second direction parallel with a magnetic field of the second resonant mode.

14. The multi-mode cavity filter according to claim 13, wherein the first and second limbs are perpendicular to each other.

* * * * *